US005921853A

United States Patent [19]

Nishio

[11] Patent Number: 5,921,853

[45] **Date of Patent: *Jul. 13, 1999**

[54] APPARATUS FOR POLISHING SUBSTRATE USING RESIN FILM OR MULTILAYER POLISHING PAD

[75] Inventor: Mikio Nishio, Osaka, Japan

[73] Assignee: Matsushita Electric Industrial Co., Ltd., Osaka, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/811,355

[22] Filed: Mar. 4, 1997

Related U.S. Application Data

[62] Division of application No. 08/629,691, Apr. 9, 1996, Pat. No. 5,791,973.

[30] Foreign Application Priority Data

| | | | |
|---|---|---|---|
| Apr. 10, 1995 | [JP] | Japan | 7-083860 |
| Jun. 8, 1995 | [JP] | Japan | 7-141536 |
| Nov. 30, 1995 | [JP] | Japan | 7-312978 |

[51] Int. Cl.[6] ..... B24B 29/02; B24B 49/12; B24D 11/00

[52] U.S. Cl. ..... 451/289; 451/6; 451/8; 451/290; 451/533; 451/538

[58] Field of Search ..... 51/293; 156/344, 156/584; 451/6, 8, 41, 59, 63, 286, 287, 288, 289, 290, 397, 398, 402, 533, 538

[56] References Cited

U.S. PATENT DOCUMENTS

| | | | |
|---|---|---|---|
| 2,998,680 | 9/1961 | Lipkins | 451/289 X |
| 3,731,435 | 5/1973 | Boettcher et al. | 451/288 |
| 3,863,395 | 2/1975 | Brown | 451/533 X |

FOREIGN PATENT DOCUMENTS

| | | |
|---|---|---|
| 0 623 423 | 11/1994 | European Pat. Off. . |
| 53-131595 | 11/1978 | Japan . |
| 61-4661 | 1/1986 | Japan . |
| 61-38857 | 2/1986 | Japan . |
| 62-24962 | 2/1987 | Japan . |
| 63-144954 | 6/1988 | Japan . |
| 64-2857 | 1/1989 | Japan . |
| 64-455567 | 2/1989 | Japan . |
| 63-188265 | 7/1989 | Japan . |
| 6-91058 | 11/1990 | Japan . |
| 3-173129 | 7/1991 | Japan . |
| 3-277465 | 12/1991 | Japan . |
| 4-310365 | 11/1992 | Japan . |
| 5-69314 | 3/1993 | Japan . |
| 6-763 | 1/1994 | Japan . |
| 7-263385 | 10/1995 | Japan . |
| 8-323615 | 12/1996 | Japan . |
| WO 94/07110 | 3/1994 | WIPO . |

OTHER PUBLICATIONS

Research Disclosure, Feb. 1991, No. 322, p. 95 "Pressure Wafer Holder for Uniform Polishing".

*Primary Examiner*—Timothy V. Eley
*Attorney, Agent, or Firm*—McDermott, Will & Emery

[57] ABSTRACT

An elastic polishing pad is adhered to the top face of a rotatable table. Above the table is provided a substrate holding apparatus for holding a substrate. The substrate holding apparatus comprises a rotary shaft, a substrate holding head in the form of a disc which is provided integrally with the lower edge of the rotary shaft, a sealing member in the form of a ring which is made of an elastic material and fastened to the peripheral portion of the lower face of the substrate holding head, and a guiding member in the form of a ring which is fastened to the back face of the substrate holding head to be located outside the sealing member. A fluid under pressure is introduced into a fluid flow path formed in the rotary shaft from one end thereof and supplied to a space from the other end of the fluid flow path so as to press the substrate against the polishing pad.

(List continued on next page.)

6 Claims, 16 Drawing Sheets

U.S. PATENT DOCUMENTS

| | | | |
|---|---|---|---|
| 3,982,358 | 9/1976 | Fukuda et al. | 451/533 X |
| 4,598,502 | 7/1986 | Lombard | 451/288 |
| 4,928,438 | 5/1990 | Narimatsu et al. . | |
| 4,954,141 | 9/1990 | Takiyama et al. | 451/538 X |
| 4,954,142 | 9/1990 | Carr et al. . | |
| 5,104,828 | 4/1992 | Morimoto et al. . | |
| 5,172,448 | 12/1992 | Kitahata . | |
| 5,433,650 | 7/1995 | Winebarger | 451/6 |
| 5,441,444 | 8/1995 | Nakajima | 451/288 X |
| 5,449,316 | 9/1995 | Strasbaugh | 451/287 X |
| 5,454,750 | 10/1995 | Cosmano et al. | 451/533 X |
| 5,476,414 | 12/1995 | Hirose et al. | 451/288 |
| 5,584,751 | 12/1996 | Kobayashi et al. | 451/288 |
| 5,605,488 | 2/1997 | Ohashi et al. | 451/288 X |
| 5,624,304 | 4/1997 | Pasch et al. | 451/538 X |
| 5,649,855 | 7/1997 | Chikaki | 451/290 |

APPARATUS FOR POLISHING SUBSTRATE USING RESIN FILM OR MULTILAYER POLISHING PAD

This is a divisional of application Ser. No. 08/629,691, filed Apr. 9, 1996 now U.S. Pat. No. 5,791,973.

BACKGROUND OF THE INVENTION

The present invention relates to a method of polishing a substrate whereby chemical mechanical polishing (CMP) is performed with respect to a semiconductor substrate of silicon or a liquid-crystal substrate to flatten a surface thereof, to an apparatus for polishing a substrate, and to an apparatus for holding a substrate to be polished by the above method of polishing a substrate.

From the 1990s, as semiconductor and liquid-crystal substrates processed by CMP technology have had larger diameters on the order of 10 cm or more, there have been increasing tendencies toward single-wafer polishing. In the case of polishing a semiconductor substrate, in particular, equal polishing should be performed with respect to the entire surface thereof since a design rule of 0.5 $\mu$m or less has been used to define extremely small lines and spaces on the semiconductor substrate.

Below, a method and apparatus for polishing a substrate according to a first conventional embodiment will be described with reference to the drawings.

FIG. 13 schematically shows the structure of the apparatus for polishing a substrate according to the first conventional embodiment, in which is shown a table 51 including: a pad table 51*a* having a flat surface which is made of a rigid material; a rotary shaft 51*b* extending downwardly from the back face of the pad table 51*a;* and rotating means (not shown) for rotating the rotary shaft 51*b*. To the top surface of the pad table 51*a* of the table 51 is adhered an elastic polishing pad 52. Above the polishing pad 52 is provided a substrate holding head 54 which holds and rotates a substrate 53. The substrate 53 is pressed against the polishing pad 52 while being rotated by the substrate holding head 54. An abrasive agent 55 in a prescribed amount is supplied dropwise from an abrasive supply pipe 56 onto the polishing pad 52.

In the apparatus for polishing a substrate thus constituted, the polishing pad 52 supplied with the abrasive agent 55 is rotated by rotating the table 51 and the substrate 53 held by the substrate holding head 54 is pressed against the rotating polishing pad 52 so that a surface of the substrate 53 is polished under pressure and at a relative speed.

In this process, if the surface of the substrate 53 being polished is rugged, projecting portions thereof are removed at an increased relative polishing rate since their contact pressure with the polishing pad 52 is high. On the other hand, recessed portions thereof are barely polished since their contact pressure with the polishing pad 52 is low. Consequently, the surface of the substrate 53 to be polished becomes less rugged and more smooth.

However, the first conventional embodiment mentioned above presents the following problems, which will be described below with reference to FIG. 14 and FIGS. 15(*a*) to 15(*c*).

FIG. 14 is a schematic view illustrating a polishing method implemented by the above first conventional embodiment. FIGS. 15(*a*) to 15(*c*) are schematic views elucidating the problems of the first conventional embodiment. By way of example, a description will be given to a problem in polishing an oxide film 57 having a rugged surface which is formed on the substrate 53 of silicon.

As described above, when the substrate 53 held by the substrate holding head 54 is pressed against the polishing pad 52 as shown in FIG. 14, the projecting portions of the oxide film 57 are removed since their contact pressure with the polishing pad 52 is high, while the recessed portions thereof are barely polished since their contact pressure with the polishing pad 52 is low, resulting in a flat surface of the oxide film 57 with a reduced degree of ruggedness.

In this process, the substrate 53 held by the substrate holding head 54 is pressed against the polishing pad 52 with an equal force. However, if the pad table 51*a* of the table 51 has a warped surface and the polishing pad 52 is elastically deformed as shown in the left part of FIG. 15(*a*) or if the thickness of the substrate 53 has variations as shown in the left part of FIG. 15(*b*), the contact pressure between the oxide film 57 and the polishing pad 52 is not equal but differs from one portion to another even when the substrate 53 is pressed against the polishing pad 52 with an equal force. As a result, the polishing rate is higher at portions under higher contact pressure (these portions of the oxide film 57 which are in contact with the projecting portions of the pad table 51*a* or polishing pad 52 and which correspond to thicker portions of the substrate 53), while the polishing rate is lower at portions under lower contact pressure (these portions of the oxide film 57 which are in contact with the recessed portions of the pad table 51*a* or polishing pad 52 and which correspond to thinner portions of the substrate 53), resulting in an unequal amount of polishing with respect to the oxide film 57.

To overcome the problem, it is possible to lessen variations in contact pressure resulting from the ruggedness of the pad table 51*a* or polishing pad 52 or from varied thickness of the substrate 53 by increasing the ease with which the polishing pad 52 is elastically deformed in accordance with the ruggedness of the pad table 51*a* or polishing pad 52 or with varied thickness of the substrate 53, thereby achieving an equal contact pressure. However, when the polishing pad 52 is softened, it is deformed in accordance with the rugged configuration of the oxide film 57, so that even the recessed portions of the oxide film 57 are brought into contact with the polishing pad 52 and undergo polishing. Accordingly, variations in level on the surface of the oxide film 47 cannot be lessened as shown in the right part of FIG. 15(*c*).

To overcome the problem, there has been proposed a technique which utilizes the deformation of the substrate 63 against the elastic deformation of the polishing pad 62.

FIG. 16 shows a method and apparatus for polishing a substrate according to a second conventional embodiment, wherein an elastic polishing pad 62 is adhered to the top surface of a table 61. The bottom portion of a substrate holding head 64 for holding a substrate 63 is formed with a recessed portion 65. The substrate 63 is solidly supported by a plate-like elastic member 66 which can be elastically deformed in the recessed portion 65 of the substrate 63. The substrate holding head 64, elastic member 66, and substrate 63 define a hermetically sealed space 67 into which a gas under controlled pressure is introduced through a gas supply path 68. The gas under pressure introduced into the hermetically sealed space 67 presses the substrate 63 solidly supported by the elastic member 66 against the polishing pad 62, so that the pressure on the upper face of the substrate 63 achieves equal polishing.

However, since the second conventional embodiment is so constituted that the substrate 63 is solidly supported by the plate-like elastic member 66, there arises a first problem of a complicated mechanism and intricate operation of mounting and dismounting the substrate 63.

In the foregoing first conventional embodiment, on the other hand, the polishing pad 52 have different thicknesses from one portion to another due to elastic deformation caused by pressure during polishing or loading is caused by abrasive grains which have been jammed into the surface of the polishing pad 52, so that the surface state of the polishing pad 52 changes and the polishing rate varies. Moreover, a friction between the substrate 53 and the polishing pad 52 causes partial abrasion of the polishing pad 52 or the polishing pad 52 itself is thinned since the polishing pad 52 elastically deformed under pressure during polishing is not restored.

Consequently, the surface of the polishing pad 52 becomes rugged due to varied thickness of the polishing pad 52 so that variations in pressure are produced over the surface of the substrate 53 even if the substrate 53 is pressed against the polishing pad 52 with an equal force, resulting in an unequal amount of polishing with respect to the surface of the substrate.

To avoid an unequal amount of polishing due to a change (fatigue) in the surface state of the polishing pad 52, a dressing process is performed with respect to the polishing pad 52, in which projecting portions are removed from the surface of the polishing pad 52 or the loading is eliminated to maintain the polishing pad 52 in a constant state and thereby accomplish equal polishing with respect to the surface of the substrate 53.

However, the method in which the dressing process is performed with respect to the polishing pad has the following problems.

First, to impart constant flatness to the surface of the polishing pad which undergoes changes caused by abrasion or the like during polishing, it is necessary to control the amount of removal from the polishing pad based on the height and depth of projecting and recessed portions formed during polishing. However, it is extremely difficult to measure the height and depth of the projecting and recessed portions and control the amount of removal since the height and depth of the projecting and recessed portion from the surface level of the polishing pad is as small as several micrometers to several tens of micrometers. In particular, it is extremely difficult to polish the surface of the substrate with such an accuracy as is required in the latest device manufacturing process.

Second, since the removal from the polishing pad by the dressing process reduces the thickness of the polishing pad, the elasticity of the polishing pad changes and the ability to absorb variations in pressure on the surface of the substrate differs from one dressing process to another, so that steady polishing characteristics (surface uniformity and the ability to tolerate variations in level) cannot be obtained.

Third, although it is required to replace polishing pads which are sufficiently thick to implement the polishing characteristics, the replacing operation should be performed manually.

Fourth, although the above first problem can be overcome to a certain extent if variations in pressure on the surface of the substrate is absorbed by the use of a polishing pad which is liable to elastic deformation, the ability to tolerate variations in the level of the substrate is lowered by the use of the polishing pad which is liable to elastic deformation.

Fifth, although the thickness of the polishing pad adhered to the table is measured mechanically, it is difficult to measure the thickness of the polishing pad soaked with an abrasive agent or cleaning water. Moreover, in the case where a sequence of polishing processes are performed on end, it is impossible to measure the thickness of the polishing pad. Furthermore, when measured mechanically, the thickness of the polishing pad can only be estimated empirically based on the amount of polishing and on the amount of abrasion of the polishing pad for such reasons that the distribution of thickness over the surface of the polishing pad cannot be estimated unless measurements are performed at a large number of points and that high-accuracy measurements cannot be performed since the measurement accuracy in a microgage normally used is on the order of 10 $\mu$m, though the surface of the polishing pad is formed with projecting and recessed portions which are about several micrometers in height and depth.

SUMMARY OF THE INVENTION

In view of the foregoing, a first object of the present invention is to enable equal polishing with respect to a substrate even when a table or polishing pad is rugged or the thickness of the substrate varies from one portion to another, while facilitating the mechanism and operation of mounting and dismounting the substrate. A second object of the present invention is to enable flattening of the surface of the polishing pad without performing a dressing process. A third object of the present invention is to correctly estimate the thickness of the polishing pad provided over the table.

To achieve the above first object, the present invention uses a substrate holding head which attracts and holds a substrate to be polished by suction and which defines a space in conjunction with the substrate to be polished such that the substrate is pressed against the polishing pad by a fluid under pressure supplied to the space.

A first apparatus for holding a substrate to be polished according to the present invention is for holding the substrate and pressing the held substrate against a polishing pad, the above apparatus comprising: a substrate holding head which can move toward and away from the above polishing pad, the above substrate holding head having substrate attracting means for attracting the substrate by suction and a fluid supply path which allows a fluid under pressure supplied from one end thereof to flow out from the other end thereof; and an annular sealing member fastened to a portion of the above substrate holding head which surrounds the other end of the above fluid supply path, the above annular sealing member defining a space in conjunction with the above substrate holding head and the substrate disposed on the above polishing pad, wherein the substrate disposed on the above polishing pad is pressed against the above polishing pad under a pressure of the fluid supplied from the other end of the above fluid supply path to the above space.

In the first apparatus for holding a substrate to be polished, since the substrate holding head has the substrate attracting means, the substrate can be attracted and held by suction such that it is conveyed to a position above the polishing pad.

Moreover, since the annular sealing member is provided to define the space in conjunction with the substrate holding head and the substrate disposed on the polishing pad, while the substrate holding head has a fluid supply path through which the fluid under pressure flows out, the substrate can be pressed against the polishing pad under the pressure of the fluid supplied to the space. In this case, since the height and depth of projecting and recesses portions from the surface level of the polishing pad or of the table can easily be restricted to typically several hundreds of micrometers or less, the substrate can be deformed in accordance with the rugged configuration of the polishing pad with a significantly small pressing force, so that the contact pressure between the substrate and the polishing pad becomes equal even when a hard polishing pad is used.

Furthermore, since the substrate holding head and the annular sealing member do not solidly support the substrate to be polished, if the pressure of the fluid supplied to the space exceeds the pressing force applied to the substrate holding head, the fluid pushes up the sealing member and the substrate holding head and flows to the outside through the clearance between the sealing member and the substrate, so that the pressure exerted on the substrate by the fluid becomes substantially equal to the pressing force applied to the substrate holding head in a spontaneous manner. Consequently, the substrate is pressed against the polishing pad with a steady pressing force.

A second apparatus for holding a substrate to be polished according to the present invention is for holding the substrate and pressing the held substrate against a polishing pad, the above apparatus comprising: a substrate holding head which can move toward and away from the above polishing pad, the above substrate holding head having substrate attracting means for attracting the substrate by suction and a fluid supply path which allows a fluid under pressure supplied from one end thereof to flow out from the other end thereof; and an annular sealing member which can be brought in contact with and apart from a portion of the above substrate holding head which surrounds the other end of the above fluid supply path, the above annular sealing member defining a space in conjunction with the above substrate holding head and the substrate disposed on the above polishing pad, wherein the substrate disposed on the above polishing pad is pressed against the above polishing pad under a pressure of the fluid supplied from the other end of the above fluid supply path to the above space.

With the second apparatus for holding a substrate to be polished, the substrate can be attracted and held by suction such that it is conveyed to a position above the polishing pad, similarly to the first apparatus for holding a substrate to be polished. In addition, the substrate can be pressed against the polishing pad under the pressure of the fluid supplied to the space.

Thus, with the first and second apparatus for holding a substrate to be polished, since the substrate can be attracted and held by suction such that it is conveyed to a position above the polishing pad, the mounting and dismounting of the substrate and the conveyance thereof can be implemented easily and reliably with a simple structure. Moreover, since the substrate can be pressed against the polishing pad under the pressure of the fluid supplied to the space defined by the substrate holding head, the annular sealing member, and the substrate disposed on the polishing pad, the pressure exerted on the substrate to press it against the polishing pad is steady and equal even when the polishing pad is rugged, the substrate is deformed, or foreign substances such as particles are attached to the upper face of the substrate, resulting in equal polishing with respect to the substrate.

Preferably, the first apparatus for holding a substrate to be polished further comprises a guiding member provided on the above substrate holding head to be located outside the above sealing member, the above guiding member holding the substrate disposed on the above polishing pad in a given position. Preferably, the second apparatus for holding a substrate to be polished further comprises a guiding member provided on the above substrate holding head to be located outside the above sealing member, the above guiding member holding the substrate disposed on the above polishing pad in a given position. With the arrangements, the substrate disposed on the polishing pad can be held positively in a given position.

In the second apparatus for holding a substrate to be polished, the above sealing member is preferably provided so as to move toward the substrate and press a peripheral portion of the substrate against the above polishing pad during polishing. With the arrangement, there can be avoided the floating of the peripheral portion of the substrate during polishing.

In this case, the above sealing member is preferably provided so as to press the peripheral portion of the substrate against the above polishing pad when the pressure of the fluid supplied from the other end of the above fluid supply path to the above space is exerted thereon. With the arrangement, the peripheral portion of the substrate can be pressed against the polishing pad under the same pressure as exerted on the other portion thereof, so that the substrate can be polished more equally.

Preferably, the first or second apparatus for holding a substrate to be polished further comprises means for causing the fluid under pressure supplied to the above space to flow to an outside of the above space.

With the arrangement, even when the pressure of the fluid supplied to the space exceeds the pressing force applied to the substrate holding head and therefore the polishing pad is elastically deformed or an abrasive agent flows into the clearance between the guiding member and the polishing pad, the fluid smoothly flows to the outside, so that the fluid is prevented from flowing into the clearance between the substrate and the polishing pad and pushing up the substrate.

A third apparatus for holding a substrate to be polished is for holding the substrate and pressing the held substrate against a polishing pad, the above apparatus comprising: a substrate holding head which can move toward and away from the above polishing pad, the above substrate holding head having substrate attracting means for attracting the substrate by suction and a fluid supply path which allows a fluid under pressure supplied from one end thereof to flow out from the other end thereof; and a guiding member fastened to a portion of the above substrate holding head which surrounds the other end of the above fluid supply path, the above guiding member holding the substrate disposed on the above polishing pad in a given position, wherein the substrate disposed on the above polishing pad is pressed against the above polishing pad under a pressure of the fluid supplied from the other end of the above fluid supply path to a region surrounded by the above substrate holding head, the above guiding member, and the substrate disposed on the above polishing pad.

With the third apparatus for holding a substrate to be polished, the substrate can be attracted and held by suction such that it is conveyed to a position above the polishing pad, similarly to the first apparatus for holding a substrate to be polished. Accordingly, the mounting and dismounting of the substrate and the conveyance thereof can be implemented easily and reliably with a simple structure.

Moreover, since the substrate can be pressed against the polishing pad under the pressure of the fluid supplied to and passing through a region defined by the substrate holding head, the guiding member, and the substrate disposed on the polishing pad, the pressure exerted on the substrate to press it against the polishing pad is steady and equal even when the polishing pad is rugged, the substrate is deformed, or foreign substances such as particles are attached to the upper face of the substrate, resulting in equal polishing with respect to the substrate.

In the first to third apparatus for holding a substrate to be polished, it is preferable that the above guiding member is formed annually and has a connecting path between an inside and an outside thereof. With the arrangement, the space can be defined by the substrate holding head, the guiding member, and the substrate, so that the substrate can be pressed equally by the fluid supplied to the space. In the case where the pressure of the fluid becomes excessively large in the space, the fluid is allowed to flow to the outside through the connecting path.

In the first to third apparatus for holding a substrate to be polished, it is preferable that a portion of the above substrate holding head in which the other end of the above fluid supply path is opened is formed as a flat surface, the above apparatus further comprising means for setting a distance between the above flat surface and the substrate disposed on the above polishing pad to a value equal to or larger than $1/1000$ of a diameter of the substrate. With the arrangement, there can be avoided the production of a resistance to the flow of the fluid passing through the clearance between the substrate and the substrate holding head and hence variations in the pressure of the fluid for pressing the substrate, so that the substrate can be polished more equally.

A first method of polishing a substrate according to the present invention is for polishing the substrate by pressing the substrate against a rotating polishing pad, the above method comprising: a first step of lifting and holding the substrate to be polished by suction by means of a substrate holding head so as to convey the held substrate to a position above the above polishing pad; a second step of releasing the substrate conveyed to the position above the above polishing pad from the above substrate holding head so as to dispose the substrate on the above polishing pad; and a third step of supplying a fluid under pressure to a portion above the substrate disposed on the above polishing pad so as to press the substrate against the above polishing pad by means of the supplied fluid under pressure.

By the first method of polishing a substrate, the substrate to be polished is lifted and held by suction by the substrate holding head and then conveyed to a position above the polishing pad, so that the substrate can be held and conveyed easily.

Moreover, since the fluid under pressure is supplied to a portion above the substrate disposed on the polishing pad such that the substrate is pressed against the polishing pad under the pressure of the supplied fluid, the pressure exerted on the substrate to press it against the polishing pad is equal even when the polishing pad is rugged, the substrate is deformed, and foreign substances such as particles are attached to the upper face of the substrate, resulting in equal polishing with respect to the substrate.

In the first method of polishing a substrate, the above third step preferably includes the step of supplying the fluid under pressure to a space defined by the above substrate holding head, an annular sealing member fastened to the above substrate holding head, and the substrate disposed on the above polishing pad. With the arrangement, the substrate can be pressed against the polishing pad by the fluid supplied to the above space, resulting in more equal polishing with respect to the substrate.

In the first method of polishing a substrate, the above third step preferably includes the step of supplying the above fluid under pressure to a space defined by the above substrate holding head, an annular sealing member which can be brought into contact with and apart from the above substrate holding head, and the substrate disposed on the above polishing pad. With the arrangement, the substrate can be pressed against the polishing pad by the fluid supplied to the above space, resulting in more equal polishing with respect to the substrate.

In the first method of polishing a substrate, the above third step preferably includes the step of pressing the above substrate holding head against the above polishing pad with a given pressing force and a pressure per unit area of the fluid supplied to the above space is preferably larger than a pressure obtained by dividing the above given pressing force by an area of a surface of the substrate to be polished. With the arrangement, the fluid presses the substrate to be polished while flowing from the space to the outside, so that variations in the pressure of the fluid acting on the substrate are reduced, resulting in more equal polishing with respect to the substrate.

In this case, the pressure per unit area of the fluid supplied to the above space is preferably any value in a range of 1.1 to 2.2 times the pressure obtained by dividing the above given pressing force by the area of the surface of the substrate to be polished. With the arrangement, the flow velocity of the fluid is prevented from becoming excessively small because the fluid barely flows out of the space. Conversely, the flow velocity of the fluid is prevented from becoming excessively large because an excessive amount of fluid has flown out of the space. Consequently, variations in the pressure of the fluid are further reduced, resulting in more equal polishing with respect to the substrate.

In the first method of polishing a substrate, an annular guiding member for holding the substrate disposed on the above polishing pad in a given position is preferably provided on the above substrate holding head to be located outside the above sealing member, the above third step preferably includes the step of pressing the above substrate holding head against the above polishing pad with a given pressing force, and a pressure per unit area of the fluid supplied to the above space is preferably smaller than a pressure obtained by dividing the above given pressing force by an area of a surface of the substrate to be polished. With the arrangement, the fluid is prevented from flowing into the clearance between the substrate and the polishing head and lifting the substrate and the sealing member which can be brought in contact and apart from the substrate holding head.

In this case, the pressure per unit area of the fluid supplied to the above space is preferably less than a pressure obtained by dividing the above given pressing force by the area of the surface of the substrate to be polished. With the arrangement, there can be avoided the lifting of the sealing member and substrate resulting from an increase in the pressure of the fluid supplied to the space. On the other hand, since the pressing force applied to the substrate holding head does not become excessively large compared with the pressure of the fluid, the guiding member is prevented from being forcibly pressed against the polishing pad.

In the first method of polishing a substrate, the above substrate holding head is preferably provided with an annular guiding member for holding the substrate disposed on the above polishing pad in a given position, the above first step preferably includes the step of holding the substrate by means of the above substrate holding head such that a surface of the substrate to be polished is positioned higher than a back face of the above guiding member, and the above third step preferably includes the step of moving the above substrate holding head to a position at which the surface of the substrate to be polished is substantially flush with the back face of the above guiding member. With the arrangement, the pressure exerted on the substrate by the fluid supplied to the space and the pressing force applied to the guiding member are substantially equalized, so that the substrate can be pressed against the polishing pad while the fluid supplied to the space is barely allowed to flow out of the space.

In the first method of polishing a substrate, the above third step preferably includes the step of pressing the above sealing member by means of the fluid under pressure supplied to the above space so as to press a peripheral portion of the substrate against the above polishing pad. With the arrangement, there can be avoided the floating of the peripheral portion of the substrate during polishing.

In the first method of polishing a substrate, a portion of the above substrate holding head which holds the substrate is preferably formed as a flat surface and the above third step preferably includes the step of maintaining a distance between the above flat surface and the substrate disposed on the above polishing pad at a value equal to or larger than 1/1000 of a diameter of the substrate. With the arrangement, there can be avoided the production of a resistance to the flow of the fluid passing through the clearance between the substrate and the substrate holding head and hence variations in the pressure of the fluid exerting pressure on the substrate, resulting in more equal polishing with respect to the substrate.

Thus, with the first to third apparatus for holding a substrate to be polished and by the first method of polishing a substrate, the substrate can be pressed against the polishing pad under steady pressure and polished steadily. Moreover, the substrate can be polished equally even when the polishing pad or the table on which the polishing pad is disposed is rugged and the thickness of the substrate varies from one portion to another. Furthermore, the mounting and dismounting of the substrate and the conveyance thereof can be implemented with a simple structure.

A first apparatus for polishing a substrate according to the present invention comprises: a rotatable and rigid table; a resin film for polishing which is formed of a liquid resin cured over a surface of the above table; and substrate holding means for holding the substrate to be polished and pressing the held substrate onto the above resin film for polishing.

Since the first apparatus for polishing a substrate comprises a resin film for polishing formed of a liquid resin which has been spread under surface tension and cured, the surface of the resin film for polishing becomes remarkably flat and smooth without undergoing a dressing process. As a result, considerably equal polishing can be performed with respect to the surface of a substrate having a large diameter of 200 mm or more.

In the first apparatus for polishing a substrate, the above resin film for polishing is preferably formed of the resin applied by spin coating to the surface of the above table and cured. With the arrangement, the liquid resin supplied to the surface of the table can be spread uniformly over the surface of the table, so that the surface of the resin film for polishing presents further flatness and smoothness.

In the first apparatus for polishing a substrate, the above resin film for polishing preferably contains abrasive grains for polishing. With the arrangement, the substrate can be polished with the use of an abrasive agent containing no abrasive grains.

In the first apparatus for polishing a substrate, the above resin film for polishing is preferably translucent. When the intensity of light reflected by the surface of the table and passing through the translucent resin film for polishing is measured with the arrangement, the intensity of light becomes high with the polishing pad which is worn out and thinned over the entire surface thereof. With the polishing pad which is partially worn out and has a rugged surface, the intensity of the light varies from portion to portion. Accordingly, the timing of replacing the polishing pad with another can be judged correctly.

In this case, it is preferable that light intensity measuring means for measuring an intensity of light reflected by the surface of the above table and passing through the above translucent resin film for polishing is further provided. With the arrangement, the intensity of light reflected by the surface of the table and passing through the translucent resin film for polishing can be detected easily and reliably.

Preferably, the first apparatus for polishing a substrate further comprises resin supplying means for supplying the liquid resin to the surface of the above table so as to form the above resin film for polishing. With the arrangement, the liquid resin for forming the resin film for polishing can be supplied easily to the surface of the table.

In this case, it is preferable that resin curing means for curing the liquid resin supplied by the above resin supplying means to the surface of the above table is further provided so as to form the above resin film for polishing. With the arrangement, the liquid resin supplied to the surface of the table by resin supplying means can be cured simply and positively.

Preferably, the resin supplied by the above resin supplying means to the surface of the above table is thermosetting and the above resin curing means heats and cures the resin supplied by the above resin supplying mean to the surface of the above table. With the arrangement, the resin film for polishing can easily be formed by heating the thermosetting resin.

Preferably, the resin supplied by the above resin supplying means to the surface of the above table is photo-curing and the above resin curing means illuminates the resin supplied by the above resin supplying mean to the surface of the above table with an ultraviolet ray so as to cure the resin. With the arrangement, the resin film for polishing can be formed by illuminating the photo-curing resin with an ultraviolet ray with no application of heat.

Preferably, the first apparatus for polishing a substrate further comprises solvent supplying means for supplying a solvent for dissolving the above resin film for polishing onto the above table. With the arrangement, the operation of dissolving and removing the resin film for polishing can be performed easily.

A second apparatus for polishing a substrate according to the present invention comprises: a rotatable and rigid table; a translucent polishing pad provided over a surface of the above table; substrate holding means for holding the substrate to be polished and pressing the held substrate against the above polishing pad; and light intensity measuring means for measuring an intensity of light reflected by the surface of the above table and passing through the above translucent polishing pad.

When the intensity of light reflected by the surface of the table and passing through the translucent polishing pad is measured with the second apparatus for polishing a substrate, the intensity of light becomes high with the polishing pad which is worn out and thinned over the entire surface thereof. With the polishing pad which is partially worn out and has a rugged surface, the intensity of light varies from portion to portion. Consequently, if the measured intensity of light is high or varied from one portion to another, it can be understood that the polishing pad is at the end of its lifetime, so that the timing of replacing the polishing pad with another can be judged correctly.

A third apparatus for polishing a substrate according to the present invention comprises: a rotatable and rigid table; a multilayer polishing pad provided on a surface of the above table and having a colored lower layer and a translucent upper layer; substrate holding means for holding the substrate to be polished and pressing the held substrate against the above polishing pad; and light intensity measuring means for measuring an intensity of light reflected by a surface of the above lower layer of the above polishing pad and passing through the above translucent upper layer thereof.

When the intensity of light reflected by the surface of the lower layer of the polishing pad and passing through the translucent upper layer thereof is measured with the third apparatus for polishing a substrate, the intensity of light becomes high with the polishing pad which is worn out and thinned over the entire surface thereof. With the polishing pad which is partially worn out and has a rugged surface, the intensity of light varies from portion to portion. Consequently, if the measured intensity of light is high or varied from one portion to another, it can be understood that the polishing pad is at the end of its lifetime, so that the timing of replacing the polishing pad with another can be judged correctly.

A second method of polishing a substrate according to the present invention comprises the steps of: applying a liquid resin by spin coating to a surface of a rigid table; curing the above resin applied by spin coating to the surface of the above table so as to form a resin film for polishing; and holding the substrate to be polished and pressing the held substrate against the above resin film for polishing so as to polish the substrate.

By the second method of polishing a substrate, when the liquid resin is applied to the surface of the table by spin coating and cured to form the resin film for polishing thereon, the liquid resin is spread uniformly over the surface of the table under surface tension, so that the resin film for polishing having a remarkably flat and smooth surface can be obtained without a dressing process, resulting in considerably equal polishing with respect to the surface of the substrate.

In the second method of polishing a substrate, the above resin film for polishing preferably contains abrasive grains for polishing. With the arrangement, the substrate can be polished with the use of an abrasive agent containing no abrasive grains.

In the second method of polishing a substrate, the above resin film for polishing is preferably translucent. With the arrangement, the timing of replacing the polishing pad with another can be judged correctly by measuring the intensity of light reflected by the surface of the table and passing through the translucent resin film for polishing.

Preferably, the second method of polishing a substrate further comprises the step of removing the above resin film for polishing from the surface of the above table. With the arrangement, a new resin film for polishing having a flat surface can be formed by supplying a resin to the surface of the table.

Preferably, the second method of polishing a substrate further comprises the step of supplying a resin to a rugged surface of the above resin film for polishing so as to flatten the surface of the resin film for polishing. With the arrangement, the surface of the resin film for polishing can be flattened without the removal of the resin film for polishing.

A third method of polishing a substrate according to the present invention comprises the steps of: rotating a rigid table with a translucent polishing pad provided over a surface thereof; pressing the substrate to be polished against the above polishing pad so as to polish a surface of the above substrate; and measuring an intensity of light reflected by the surface of the above table and passing through the above translucent polishing pad so as to estimate a film thickness of the above polishing pad based on the measured intensity of light.

When the intensity of light reflected by the surface of the table and passing through the translucent polishing pad is measured with the third method of polishing a substrate, the intensity of light becomes high with the polishing pad which is worn out and thinned over the entire surface thereof. With the polishing pad which is partially worn out and has a rugged surface, the intensity of light varies from portion to portion. Consequently, if the measured intensity of light is high or varied from one portion to another, it can be understood that the polishing pad is at the end of its lifetime, so that the timing of replacing the polishing pad with another can be judged correctly.

A fourth method of polishing a substrate according to the present invention comprises the steps of: rotating a rigid table with a multilayer polishing pad having a colored lower layer and a translucent upper layer provided over a surface thereof; pressing the substrate to be polished against the above polishing pad so as to polish a surface of the above substrate; and measuring an intensity of light reflected by a surface of the above lower layer of the above polishing pad and passing through the above translucent upper layer thereof so as to estimate a film thickness of the above polishing pad based on the measured intensity of light.

When the intensity of light reflected by the surface of the lower layer of the polishing pad and passing through the translucent upper layer thereof is measured with the fourth method of polishing a substrate, the intensity of light becomes high with the polishing pad which is worn out and thinned over the entire surface thereof. With the polishing pad which is partially worn out and has a rugged surface, the intensity of light varies from portion to portion. Consequently, if the measured intensity of light is high or varied from one portion to another, it can be understood that the polishing pad is at the end of its lifetime, so that the timing of replacing the polishing pad with another can be judged correctly.

DETAILED DESCRIPTION OF THE INVENTION

Below, an apparatus for holding a substrate to be polished and a method and apparatus for polishing a substrate according to each embodiment of the present invention will be described with reference to the drawings.

First Embodiment

Figure 1:
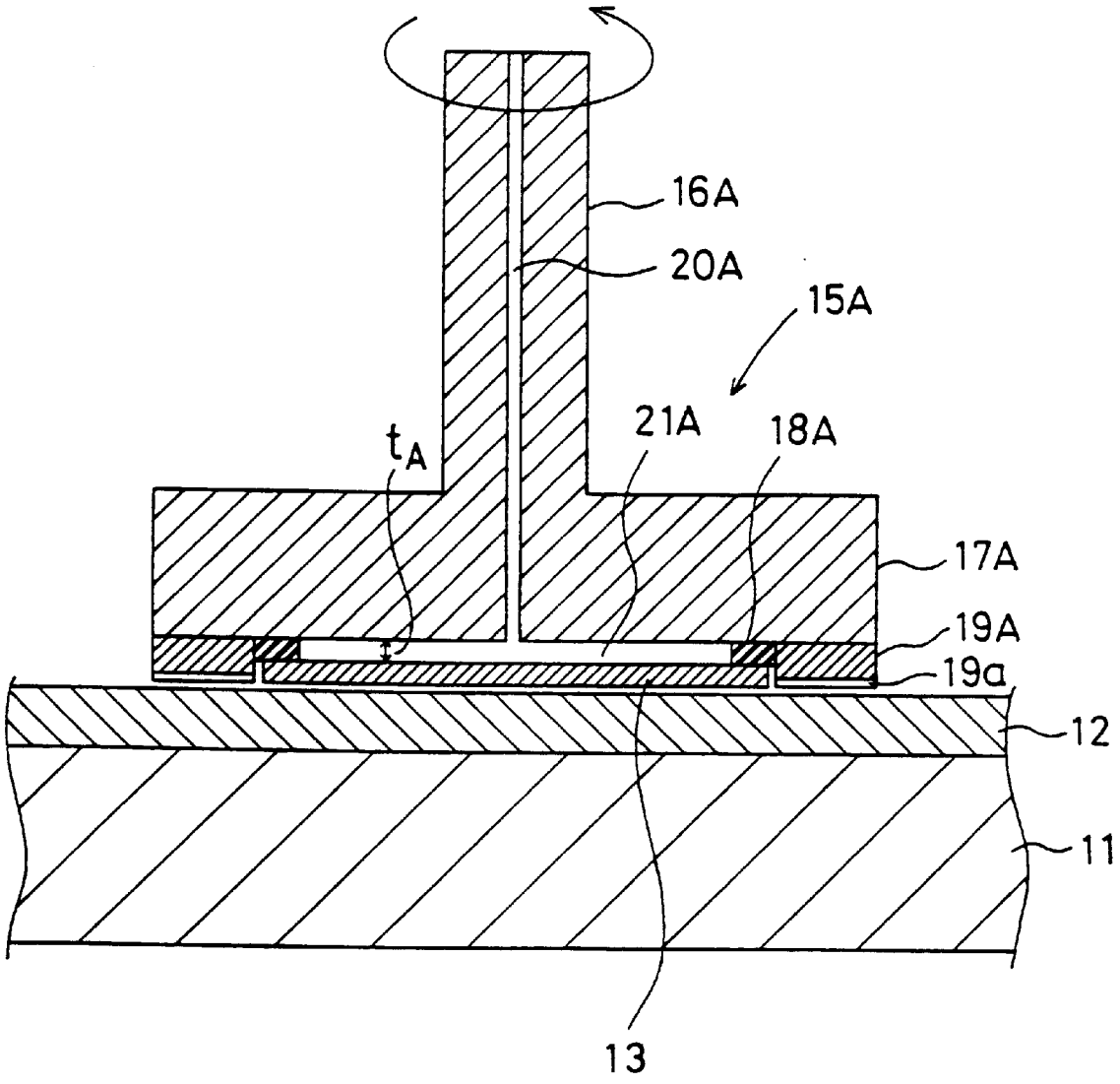
FIG. 1 is a schematic cross-sectional view of an apparatus for holding a substrate to be polished according to a first embodiment of the present invention.

FIG. 1 is a schematic cross-sectional view of an apparatus for holding a substrate to be polished according to a first embodiment of the present invention, in which are shown: a rotatable table 11 having a flat surface which is made of a rigid material; and an elastic polishing pad 12 adhered to the top surface of the table 11.

Above the table 11 is provided a substrate holding apparatus 15A for holding a substrate 13, which comprises: a rotary shaft 16A rotated by rotary driving means (not shown); a substrate holding head 17A in the form of a disc which is provided integrally on the lower edge of the rotary shaft 16A; a sealing member 18A in the form of a ring which is made of an elastic material such as a silicon rubber and fastened to the peripheral portion of the back face of the substrate holding head 17A: a guiding member 19A in the form of a ring which is fastened to the back face of the substrate holding head 17A outside the sealing member 18A; and a fluid flow path 20A as a fluid supply path which allows a fluid under pressure introduced from one end thereof (upper end in FIG. 1) to flow out from the other end thereof (lower end in FIG. 1).

Below, a description will be given to a method of polishing a substrate implemented by means of the apparatus for holding a substrate to be polished according to the first embodiment with reference to FIGS. 2(*a*) and 2(*b*).

A description will be given first to operation during the conveyance of the substrate 13. The substrate 13 or substrate holding apparatus 15A is moved horizontally so that the substrate 13 is placed under the substrate holding head 17A. The substrate holding head 17A is then moved downward to be closer to the substrate 13. Subsequently, the atmosphere under the substrate holding head 17A is sucked through the fluid flow path 20A so that the substrate 13 is attracted and held by the substrate holding head 17A via the sealing member 18A, as shown in FIG. 2(*a*). The substrate holding head 17A holding the substrate 13 is conveyed horizontally to a position above the polishing pad 12 over the table 11. In this manner, the substrate 13 can be held and conveyed easily and positively.

Next, the structure of the apparatus for holding a substrate to be polished according to the first embodiment will be described in detail, while operation during polishing is described.

Figure 2A:
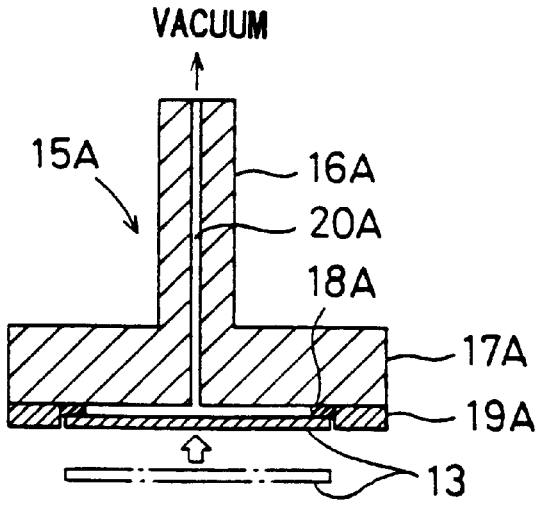
FIGS. 2(*a*) and 2(*b*) are schematic views showing respective steps of a polishing method using the above apparatus for holding a substrate to be polished according to the first embodiment.
Figure 2B:
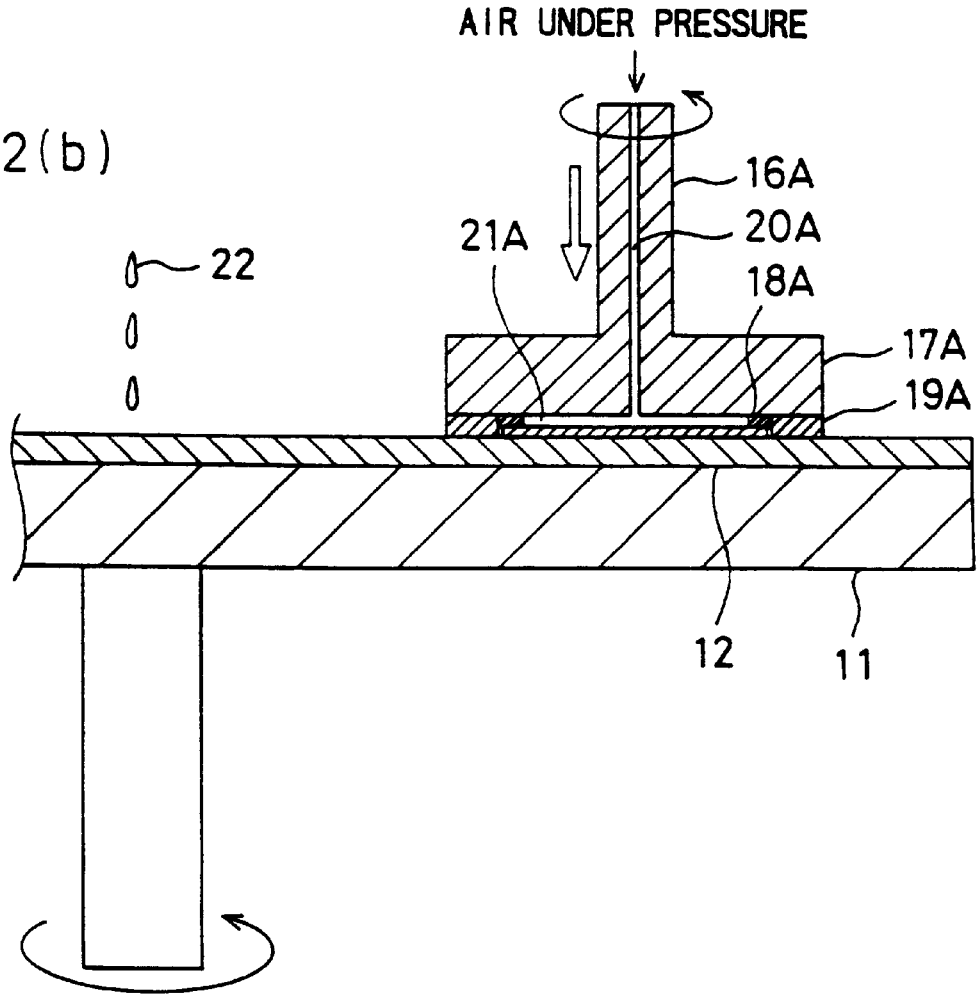

As shown in FIG. 2(*b*), an atmospheric pressure is achieved in the fluid flow path 20A to release the substrate 13, thereby placing the substrate 13 on the polishing pad 12, followed by the application of a downward force to the rotary shaft 16A. In the case of pressing the substrate 13 of silicon having a diameter of 8 inches against the polishing pad 12 under a pressure of 500 g/cm$^2$ so that the substrate 13 is polished, the pressing force applied to the rotary shaft 16A becomes 157 kg. In this case, a space 21A defined by the substrate holding head 17A, sealing member 18A, and substrate 13 is supplied with a fluid under pressure composed of, e.g., an air or nitrogen under pressure of 800 g/cm$^2$ through the fluid supply path 20A. Subsequently, the table 11 and the substrate holding head 17A are rotated relative to each other, while an abrasive agent 22 containing abrasive grains is supplied dropwise onto the polishing pad 12. Since the substrate 13 slides over the polishing pad 12 with its lower face kept in contact with the polishing pad 12, the polished face of the substrate 13 becomes less rugged and more smooth. The guiding member 19A prevents the substrate 13 from thrusting out due to a centrifugal force accompanying the rotation and holds it in a given position.

Here, a consideration will be given to the height $t_A$ (see FIG. 1) of the space 21A. Although the fluid under pressure supplied to the space 21A through the fluid flow path 20A presses the substrate 13 from its upper face against the polishing pad 12, the fluid under pressure leaks out of the space 21A through the clearance between the substrate 13 and the sealing member 18A. If the height $t_A$ of the space 21A is small, a resistance to the flow of the fluid under pressure is produced in the space 21A, which causes variations in pressure inside the space 21A, resulting in unequal pressing of the substrate 13. Hence, it is required to set the height $t_A$ of the space 21A to a value which barely produces a pressure loss in the fluid under pressure flowing through the space 21A. The height $t_A$ of the space 21A is determined by the thickness of the sealing member 18A. In the case of using a fluid with low viscosity such as water or air (nitrogen) as the fluid under pressure, variations in pressure are rarely observed inside the space 21A if the height $t_A$ of the space 21A is set to a value equal to or larger than 1/1000, preferably a value equal to or larger than 2/1000, of a dimension of the substrate 13 (a diameter of a disc-shaped substrate 13 or a diagonal of a square substrate 13). Specifically, it is preferred to set the height $t_A$ of the space 21A to 0.5 mm by using the sealing member 18A having a thickness of 0.5 mm.

Figure 3:
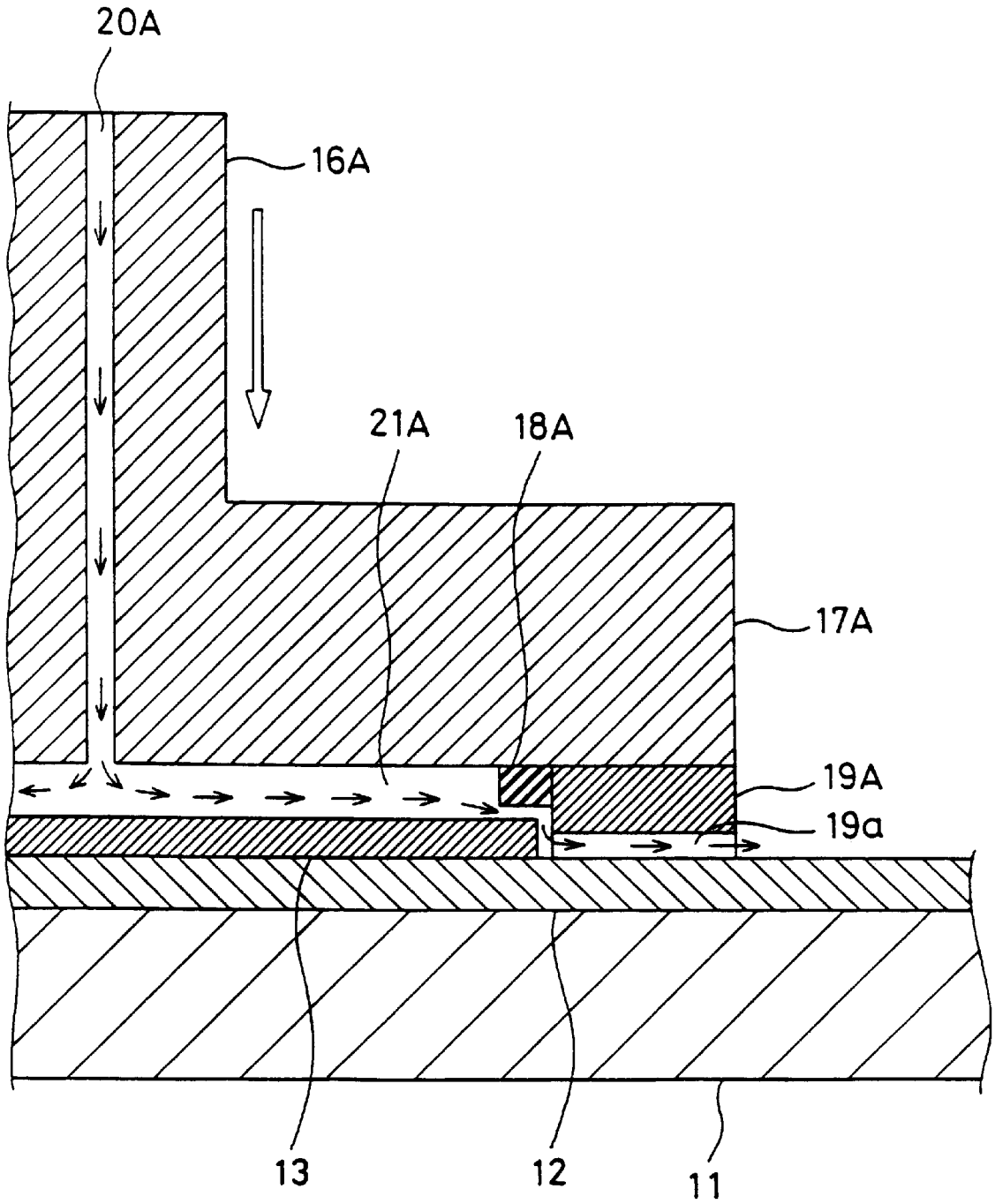
FIG. 3 is a schematic view illustrating operation in a polishing step of the polishing method using the above apparatus for holding a substrate to be polished according the first embodiment.

As described above, since the pressure of the fluid supplied to the space 21A through the fluid flow path 20A is larger than the pressing force applied to the rotary shaft 16A, if the distance between the substrate 13 and the guiding member 19A is set to about 0.1 mm, the pressure of the fluid functions as a force to push up the substrate holding head 17A, resulting in the formation of a clearance between the sealing member 18A and the substrate 13. As indicated by the arrow in FIG. 3, since the fluid under pressure flows out through the clearance between the substrate 13 and the sealing member 18A and through grooves 19*a* of the guiding member 19A, the pressure in the space 21A is lowered. As a result, the pressure of the fluid in the space 21A automatically coincides with the pressing force applied to the rotary shaft 16A so that the substrate 13 is pressed against the polishing pad 12 with a steady pressing force.

If the sum of the thickness of the substrate 13 and the thickness of the sealing member 18A is determined to be larger than the thickness of the guiding member 19A by about 0.01 to 0.1 mm so that the surface (lower face) of the substrate 13 to be polished protrudes downward from the back face of the guiding member 19A by about 0.01 to 0.1 mm, the fluid under pressure leaking out through the clearance between the substrate 13 and the sealing member 18A will flow out from below the guiding member 19A, since the guiding member 19A is kept from contact with the polishing pad 12. However, if the polishing pad 12 is elastically deformed or the abrasive agent flows into the clearance between the guiding member 19A and the polishing pad 12, there may be cases where the fluid under pressure leaking out cannot flow out smoothly from below the guiding member 19A and is confined within the inside of the guiding member 19A. If the fluid under pressure leaking out of the space 21A is confined within the inside of the guiding member 19A, the fluid under pressure flows into the clearance between the substrate 13 and the polishing pad 12 and serves as a force to push up the substrate 13, thus reducing a force to press the substrate 13 against the polishing pad 12. To avoid such a situation, the back face of the guiding member 19A is formed with a plurality of grooves 19*a* properly spaced which connect the inside of the guiding member 19A to the outside thereof and allow the fluid under pressure leaking out of the space 21A to flow to the outside (see FIGS. 4(*a*) and 4(*b*)).

Figure 4A:
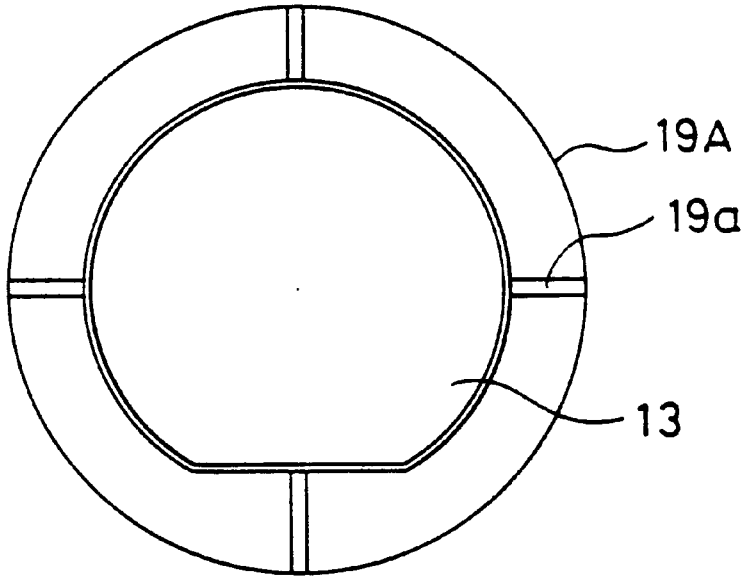
FIGS. 4(*a*) and 4(*b*) are bottom views of a guiding member in the above apparatus for holding a substrate to be polished according to the first embodiment.
Figure 4B:
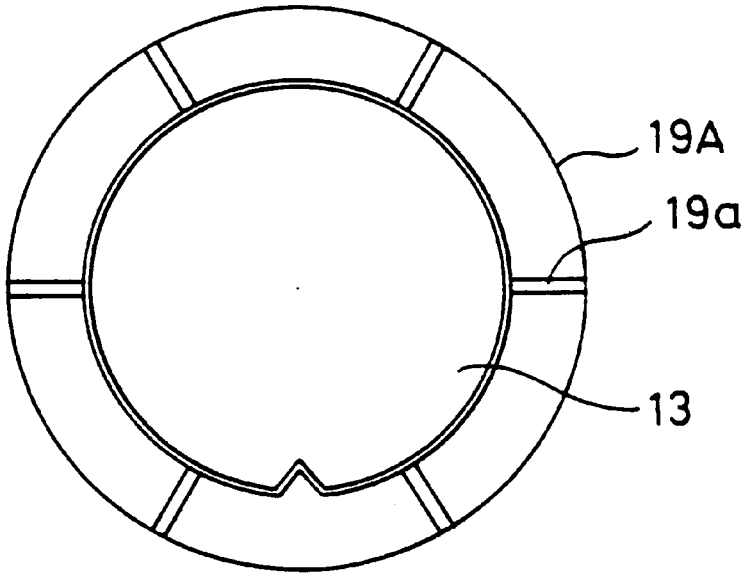

During polishing, the substrate 13 does not rotate in association with the rotating substrate holding head 17A, since the substrate 13 is kept from contact with the sealing member 18A and the guiding member 19A. Although the substrate 13 does not rotate, the rotation of the table 11 achieves relative rotation between the table 11 and the substrate 13, so that the lower face of the substrate 13 is polished. In the case where the substrate 13 should be rotated in association with the substrate holding head 17A, that portion of the inner surface of the guiding member 19A which corresponds to the orientation flat of the substrate 13 is formed linearly as shown in FIG. 4(*a*) or, alternatively, the substrate 13 is formed with a recessed portion while the guiding member 19A is formed with a projecting portion, which prevents relative rotation between the substrate 13 and the guiding member 19A. Consequently, that portion of the lower face of the substrate 13 which is in contact with the guiding member 19A is prevented from being polished and damaged.

As described above, with the apparatus for holding a substrate to be polished or by the method of polishing a substrate according to the first embodiment, the substrate 13 is pressed against the polishing pad 12 under the pressure of the fluid supplied to the space 21A, so that the substrate 13 can be pressed against the polishing pad 12 with an equal force even when the polishing surface of the polished pad 12 is rugged or the substrate 13 is deformed, resulting in equal polishing with respect to the substrate 13.

Since the lower face of the substrate is not pressed directly by the substrate holding head as in the first conventional embodiment, the substrate 13 can be pressed against the polishing pad 12 with an equal pressing force even when foreign substances such as particles are attached to the upper face of the substrate.

Moreover, since the substrate 13 can be held by the substrate holding head 17A through mere suction of the atmosphere through the fluid flow path 20A, the substrate 13 can be held and conveyed easily.

Hence, with the apparatus for holding a substrate to be polished or by the method of polishing the substrate according to the first embodiment, equal polishing can be performed with respect to the substrate 13 even when the table 11 or polishing pad 12 is rugged or the thickness of the substrate 13 varies from portion to portion, which facilitates the mounting and dismounting of the substrate 13 and the conveyance thereof.

Second Embodiment

Figure 5:
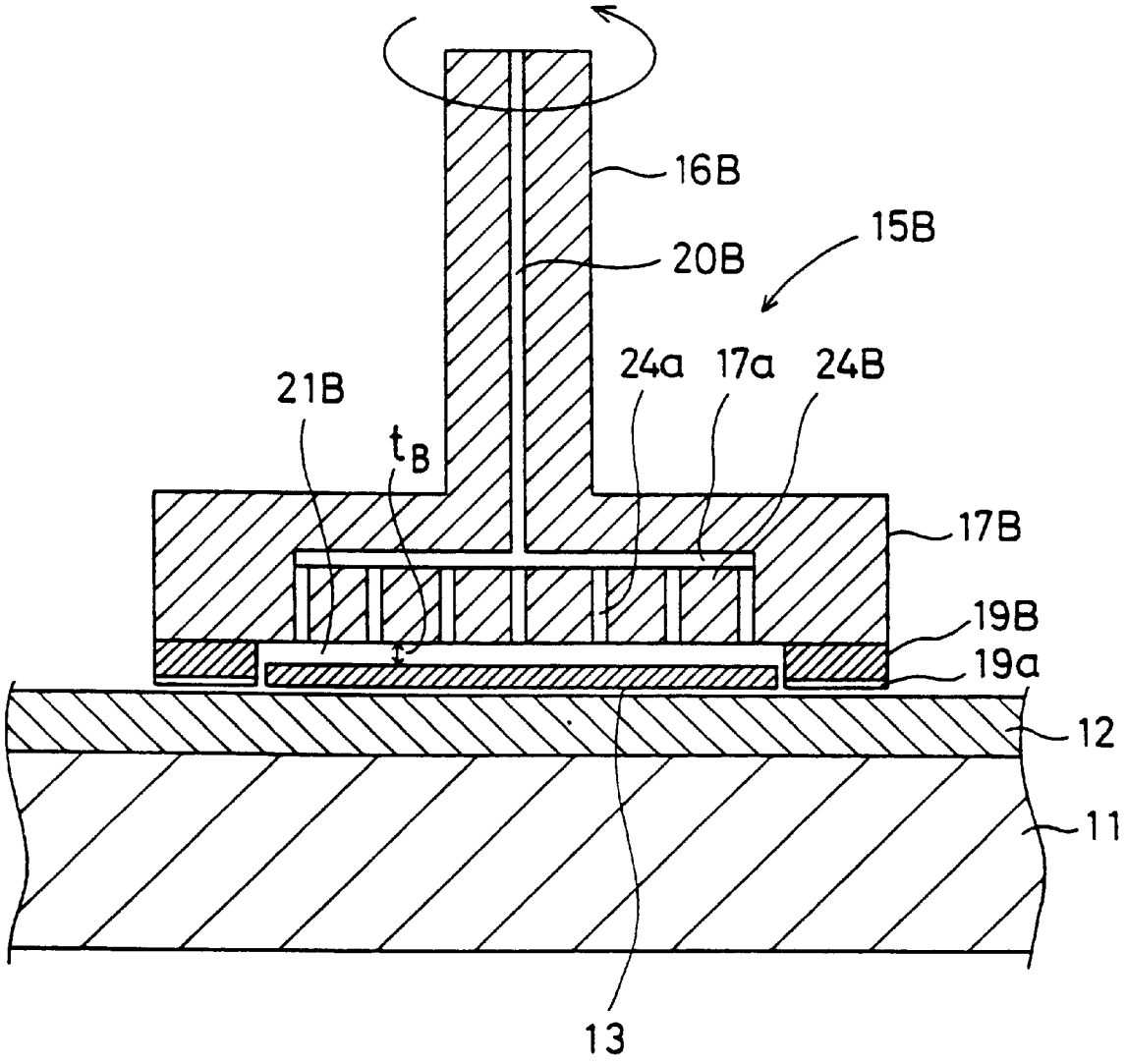
FIG. 5 is a schematic cross-sectional view of an apparatus for holding a substrate to be polished according to a second embodiment of the present invention.

FIG. 5 is a schematic cross-sectional view of an apparatus for holding a substrate to be polished according to a second embodiment of the present invention, in which is shown a rotatable table 11 having a flat surface which is made of a rigid material. To the top face of the table 11 is adhered an elastic polishing pad 12.

Above the table 11 is provided a substrate holding apparatus 15B for holding a substrate 13, which includes a rotary shaft 16B; a substrate holding head 17B in the form of a disc which is provided integrally on the lower edge of the rotary shaft 16B and has a recessed portion 17*a* in the back face thereof; a guiding member 19B in the form of a ring which is fastened to the peripheral portion of the lower face of the substrate holding head 17B; and a fluid flow path 20B.

The second embodiment is different from the first embodiment in that the sealing member 18A provided in the first embodiment is not provided in the second embodiment and that a fluid distributing plate 24B with distribution holes 24*a* are provided integrally with the substrate holding head 17B so as to distribute a fluid under pressure flowing through the fluid flow path 20B and supply the distributed fluid under pressure to a space 21B.

Moreover, although the first embodiment has used a mechanism whereby the pressure of the fluid supplied to the space 21A automatically coincides with the pressing force applied to the rotary shaft 16A, the second embodiment uses a mechanism whereby the pressure of the fluid passing through the space 21B automatically coincides with the pressing force applied to the rotary shaft 16B, while the fluid under pressure supplied to the space 21B is constantly allowed to flow to the outside, so that the substrate 13 is pressed against a polishing pad 12 under the pressure of the flowing fluid which is coincident with the pressing force applied to the rotary shaft 16B.

Below, a description will be given to a polishing method implemented by using an apparatus for polishing a substrate according to the second embodiment with reference to FIGS. 6(*a*) and 6(*b*).

A description will be given first to operation during the conveyance of the substrate 13. The substrate 13 or substrate holding apparatus 15B is moved horizontally so that the substrate 13 is placed under the substrate holding head 17B. The substrate holding head 17B is then moved downward to be closer to the substrate 13. Subsequently, the air is discharged by suction from the recessed portion 17*a* of the substrate holding head 17B through the fluid flow path 20B to achieve a reduced pressure in the space below the fluid distributing plate 24B, so that the substrate 13 is attracted by the fluid distributing plate 24B and held positively by the substrate holding head 17B, as shown in FIG. 6(*a*). The substrate holding head 17B holding the substrate 13 is moved horizontally to convey the substrate 13 to a position above the polishing pad 12 over the table 11. In this manner, the substrate 13 can be held and conveyed easily and positively.

Next, the structure of the apparatus for holding a substrate to be polished according to the second embodiment will be described in detail, while operation during polishing is described.

The substrate 13 is placed on the polishing pad 12 by restoring an atmospheric pressure in the fluid flow path 20B and in the recessed portion 17*a* of the substrate holding head 17B, followed by the application of a downward pressing force to the rotary shaft 16B. In the case of pressing the substrate 13 of silicon having a diameter of 8 inches against the polishing pad 12 under a pressure of 500 g/cm$^2$ so that the substrate 13 is polished, the pressing force applied to the rotary shaft 16B becomes 157 kg. In this case, the space 21B defined by the substrate holding head 17B, guiding member 19B, and substrate 13 is supplied with a fluid under a pressure of, e.g., 600 g/cm$^2$. Subsequently, the table 11 and the substrate holding head 17B are rotated relative to each other, while an abrasive agent containing abrasive grains is supplied dropwise onto the polishing pad 12. Since the substrate 13 slides over the polishing pad 12 with its lower face kept in contact with the polishing pad 12, the polished face of the substrate 13 becomes less rugged and more smooth. The guiding member 19B prevents the substrate 13 from thrusting out due to a centrifugal force accompanying the rotation, similarly to the first embodiment. In the present embodiment, however, the guiding member 19B defines the space 21B in conjunction with the substrate holding head 17B, fluid distributing plate 24B, and substrate 13, which is different from the first embodiment.

Here, a consideration will be given to the height $t_B$ of the space 21B.

The fluid under pressure supplied to the space 21B through the fluid flow path 20B presses the substrate 13 from its upper face against the polishing pad 12, while flowing to the outside through the clearance between the substrate 13 and the guiding member 19B and through grooves 19*a*. If the height $t_B$ of the space 21B is small, a resistance to the flow of the fluid is produced in the space 21B, which causes variations in pressure inside the space 21B, resulting in unequal pressing of the substrate 13. Hence, it is required to set the height $t_B$ of the space 21B to a value which barely produces a pressure loss in the fluid under pressure flowing through the space 21B. The height $t_B$ of the space 21B is determined by a difference between the thickness of the guiding member 19B and the thickness of the substrate 13. In the case of using a fluid with low viscosity such as water or air (nitrogen) as the fluid under pressure, variations in pressure are rarely observed inside the space 21B if the height $t_B$ of the space 21A is set to a value equal to or larger than 1/1000, preferably a value equal to or larger 2/1000, of a dimension of the substrate 13. Specifically, it is preferred to set the height $t_B$ of the space 21B to 0.5 mm.

As for the diameter, number, and arrangement of the distribution holes 24*a* formed in the fluid distributing plate 24B, they are preferably determined such that the fluid supplied through the distribution holes 24*a* to the space 21B equally presses the substrate 13. The distribution holes 24*a* are preferably arranged concentrically and radially. The fluid distributing plate 24B may also be composed of a porous plate.

Figure 6A:
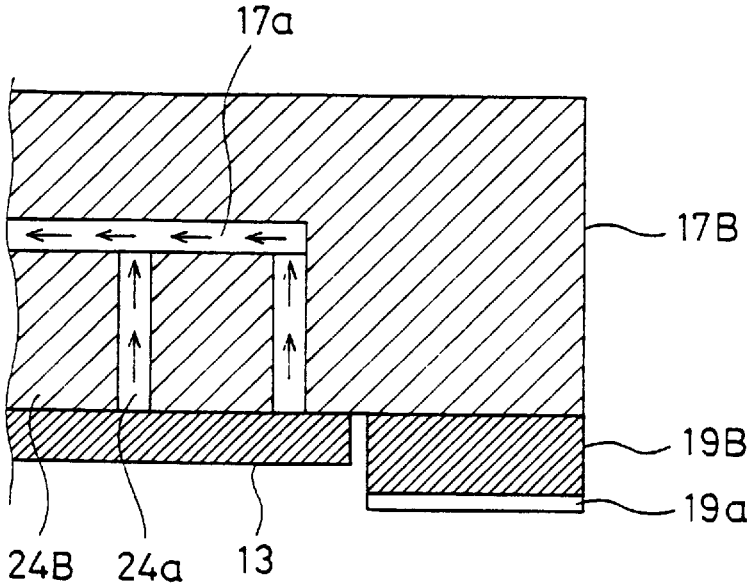
FIGS. 6(*a*) and 6(*b*) are schematic views showing respective steps of a polishing method using the above apparatus for holding a substrate to be polished according to the second embodiment.
Figure 6B:
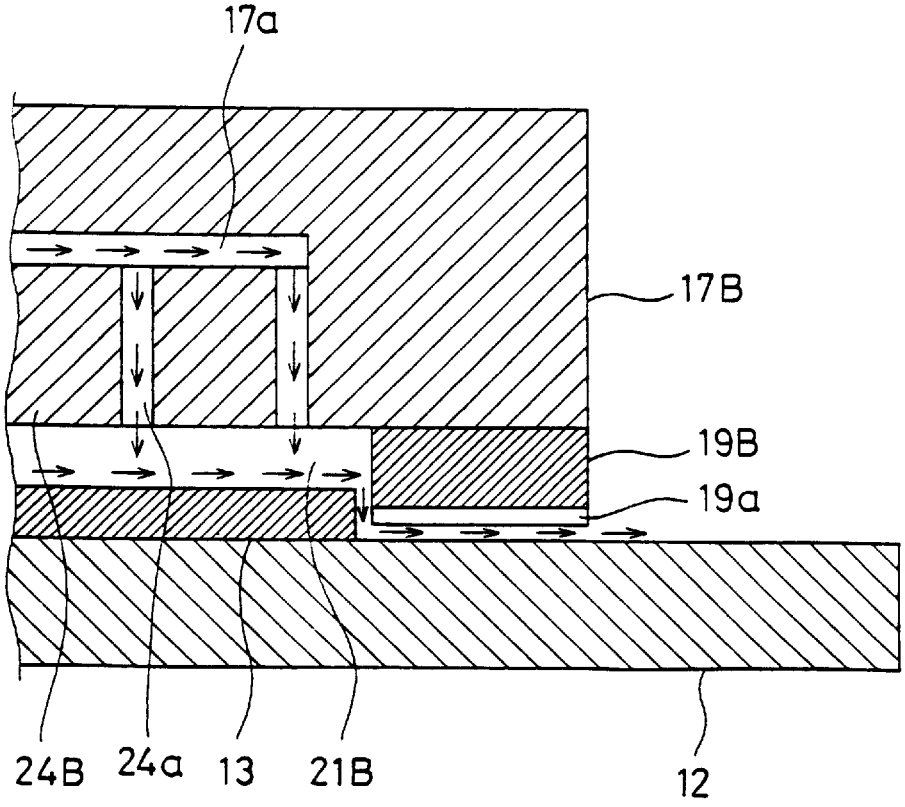

As described above, since the pressure of the fluid supplied to the space 21B through the fluid flow path 20B is larger than the pressing force applied to the rotary shaft 16B, if the distance between the substrate 13 and the guiding member 19B is set to about 0.1 mm, the fluid under pressure flows to the outside through the clearance between the substrate 13 and the guiding member 19B and through the grooves 19*a* of the guiding member 19B as indicated by the arrow in FIG. 6(*b*), which lowers the pressure in the space 21B. As a result, the pressure of the fluid under pressure passing through the space 21B automatically coincides with the pressing force applied to the rotary shaft 16B and the substrate 13 is pressed against the polishing pad 12 with a steady pressing force.

Moreover, since the pressure of the fluid supplied to the space 21B through the fluid flow path 20B is larger than the pressing force applied to the rotary shaft 16B, the pressure of the fluid serves as a force to push up the substrate holding head 17, resulting in the formation of a clearance between the substrate holding head 17 and the polishing pad 12 through which the fluid flows to the outside. However, if the polishing pad 12 is elastically deformed or the abrasive agent flows into the clearance between the guiding member 19B and the polishing pad 12, there may be cases where the fluid under pressure cannot flow to the outside smoothly from below the guiding member 19B and is confined within the inside of the guiding member 19B. If the fluid under pressure is confined within the inside of the guiding member 19B, the fluid under pressure flows into the clearance between the substrate 13 and the polishing pad 12 and pushes up the substrate 13, thus reducing a force to press the substrate 13 against the polishing pad 12. To avoid such a situation, the back face of the guiding member 19B is formed with a plurality of grooves 19*a* properly spaced, similarly to the first embodiment.

Thus, with the apparatus for holding a substrate to be polished or by the method of polishing a substrate according to the second embodiment, the pressure of the fluid supplied to the space 21B through the distribution holes 24*a* of the fluid distributing plate 24B and flowing out through the grooves 19*a* of the guiding member 19 presses the substrate 13 against the polishing pad 12, so that the substrate 13 can be pressed against the polishing pad 12 with an equal pressing force even when the polishing surface of the polishing pad 12 is rugged or the substrate 13 is deformed, resulting in equal polishing with respect to the substrate 13.

Moreover, the substrate 13 can be pressed against the polishing pad 12 with an equal pressing force even when foreign substances such as particles are attached to the upper face of the substrate.

Furthermore, since the substrate 13 can be attracted by the substrate holding head 17B through mere suction of the substrate 13 through the distribution holes 24*a* of the fluid distributing plate 24B, the substrate 13 can be held and conveyed easily.

Hence, with the apparatus for holding a substrate to be polished or by the method of polishing a substrate according to the second embodiment, equal polishing can be performed with respect to the substrate 13 even when the table 11 or polishing pad 12 is rugged or the thickness of the substrate 13 varies from portion to portion, which facilitates the mounting and dismounting of the substrate 13 and the conveyance thereof.

Third Embodiment

Figure 7:
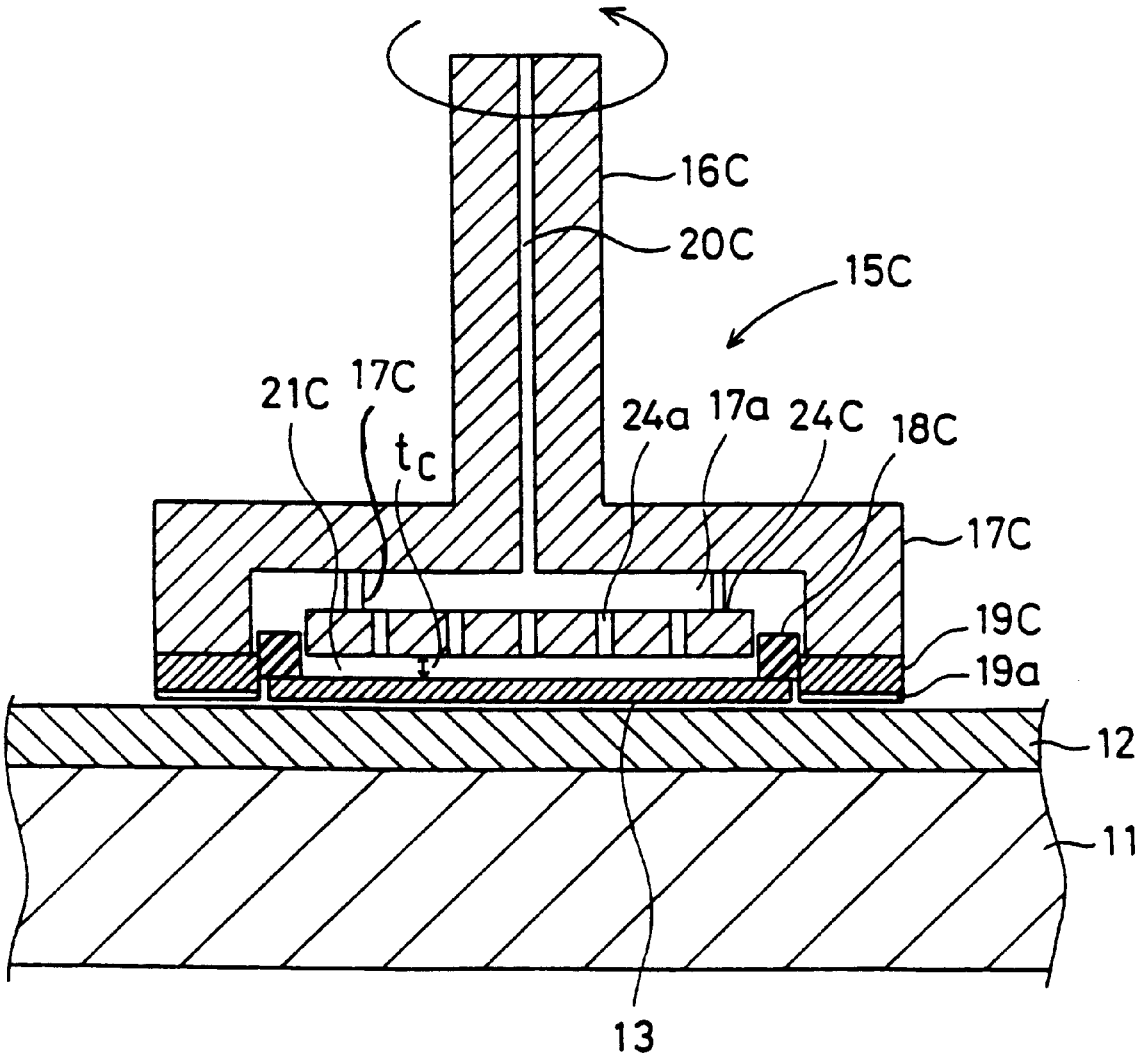
FIG. 7 is a schematic cross-sectional view of an apparatus for holding a substrate to be polished according to a third embodiment of the present invention.

FIG. 7 is a schematic cross-sectional view of an apparatus for holding a substrate to be polished according to a third embodiment of the present invention, in which is shown a rotatable table 11 having a flat surface which is made of a rigid material. To the top face of the table 11 is adhered an elastic polishing pad 12.

Above the table 11 is provided a substrate holding apparatus 15C for holding a substrate 13, which includes: a rotary shaft 16C; a substrate holding head 17C in the form of a disc which is provided integrally on the lower edge of the rotary shaft 16C and has a recessed portion 17*a* in the back face thereof; a fluid distributing plate 24C with distribution holes 24*a* which is provided integrally with the substrate holding head 17C in the recessed portion 17*a* of the substrate holding head 17C; a guiding member 19C in the form of a ring which is fastened to the peripheral portion of the back face of the substrate holding head 17C; a sealing member 18C in the form of a ring which is made of an elastic material and provided vertically movable inside the guiding member 19C; and a fluid flow path 20C. The fluid distributing plate 24C is joined to the substrate holding head 17C via bars 17*c*.

The third embodiment is different from the second embodiment in that the sealing member 18*c* is provided vertically movable inside the guiding member 19C. In this case, the height of the recessed portion 17*a* of the substrate holding head 17C is set larger than the height of the sealing member 18C.

Moreover, although the first and second embodiments have used the mechanism whereby the pressure of the fluid supplied to the space 21A or 21B automatically coincides with the pressing force applied to the substrate holding head 17A or 17B so that the pressure of the fluid which is coincident with the pressing force applied to the substrate holding head 17A or 17B presses the substrate 13 against the polishing pad 12, the third embodiment uses a mechanism whereby the pressure of the fluid supplied to the space 21C is made equal to the pressing force applied to the substrate holding head 17C so that the pressure of the fluid supplied to the space 21C presses the substrate 13 against the polishing pad 12.

Figure 8A:
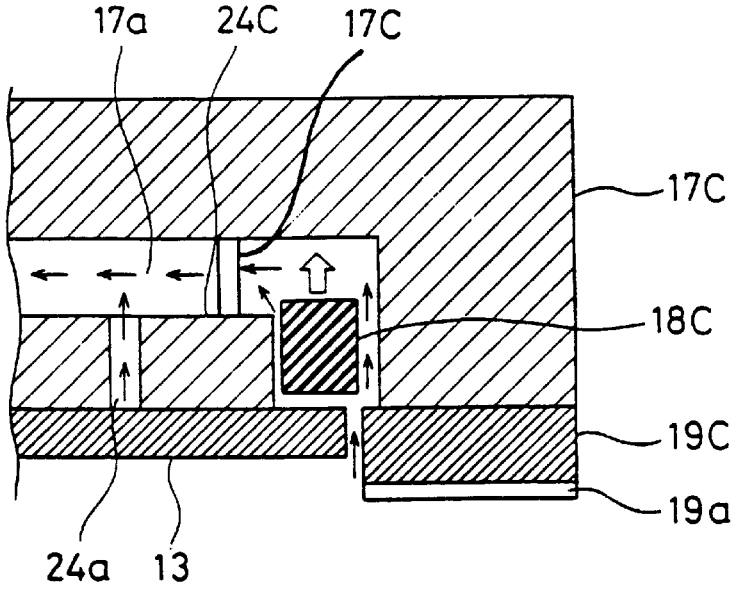
FIGS. 8(*a*) and 8(*b*) are schematic views showing respective steps of a polishing method using the above apparatus for holding a substrate to be polished according to the third embodiment.
Figure 8B:
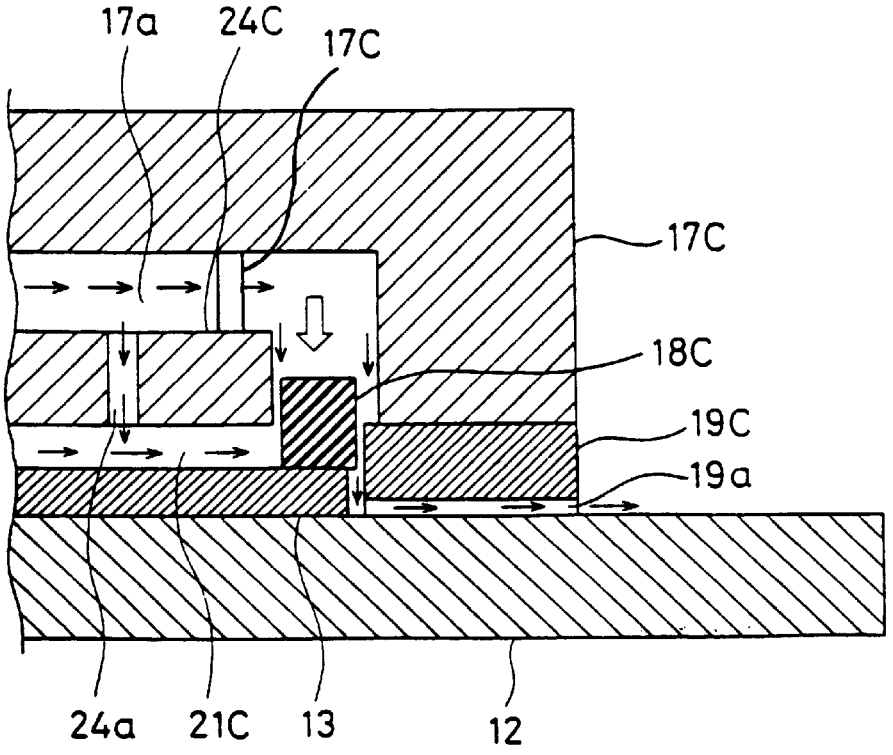

Below, a description will be given to a method of polishing a substrate implemented by the apparatus for holding a substrate to be polished according to the third embodiment with reference to FIGS. 8(*a*) and 8(*b*).

A description will be given first to operation during the conveyance of the substrate 13. The substrate 13 or substrate a holding apparatus 15C is moved horizontally so that the substrate 13 is placed under the substrate holding head 17C. The substrate holding head 17C is then moved downward to be closer to the substrate 13. Subsequently, the air is discharged by suction from the recessed portion 17*a* of the substrate holding head 17C through the fluid flow path 20C to achieve a reduced pressure in the space below the fluid distributing plate 24C, so that the substrate 13 is attracted by the fluid distributing plate 24C and held positively by the substrate holding head 17C as shown in FIG. 8(*a*). In this case, under a reduced pressure in the recessed portion 17*a* of the substrate holding head 17C, the sealing member 18C moves upward apart from the substrate 13. The substrate holding head 17C holding the substrate 13 is then moved horizontally to convey the substrate 13 to a position above the polishing pad 12, so that the substrate 13 can be held and conveyed easily and positively.

Next, the structure of the apparatus for holding a substrate to be polished according to the third embodiment will be described in detail, while operation during polishing is described.

An atmospheric pressure is restored in the recessed portion 17*a* of the substrate holding head 17C and in the space 21C by halting the suction through the fluid flow path 20C, followed by the application of a downward pressing force to the rotary shaft 16C. In the case of pressing the substrate 13 of silicon having a diameter of 8 inches against the polishing pad 12 under a pressure of 500 g/cm$^2$ so that the substrate 13 is polished, the pressing force applied to the rotary shaft 16C becomes 157 kg, which indicates that a force of 160 kg should be applied to the rotary shaft 16C. In this case, the space 21C is supplied with a fluid under a pressure of 500 g/cm$^2$. Subsequently, the table 11 and the substrate holding head 17C are rotated relative to each other, while an abrasive containing abrasive grains is supplied dropwise onto the polishing pad 12. Since the substrate 13 slides over the polishing pad 12 with its lower face kept in contact with the polishing pad 12 as shown in FIG. 8(*b*), the polished face of the substrate 13 becomes less rugged and more smooth. The sealing member 18C defines the space 21C in conjunction with the fluid distributing plate 24C and substrate 13, while the guiding member 19C functions to prevent the substrate 13 from thrusting out due to a centrifugal force accompanying the rotation.

Here, a consideration will be given to a relationship between the pressing force applied to the rotary shaft 16C and the pressure of the fluid supplied to the space 21C. When the pressing force applied to rotary shaft 16C is larger than a value obtained by multiplying the pressure of the fluid supplied to the space 21C by the area of the substrate 13, the guiding member 19C presses the polishing pad 12 to previously cause elastic deformation of the polishing pad 12, thereby effectively suppressing an increase in polishing rate at the peripheral portion of the substrate 13. Therefore, the pressure of the fluid supplied to the space 21C is preferably less than a value obtained by dividing the pressing force applied to the rotary shaft 16*c* by the area of the substrate 13 and, more preferably, the pressing force applied to the guiding member 19C is on the same level as the pressure of the fluid.

Next, a consideration will be given to the height $t_C$ of the space 21C.

Since the recessed portion 17*a* of the substrate holding head 17C is connecting to the space 21C via the distribution holes 24*a* of the fluid distributing plate 24C, the pressure in the recessed portion 17*a* is equal to the pressure in the space 21C. However, since the sealing member 18C is not fastened to the substrate holding head 17C, the fluid under pressure supplied to the space 21C leaks out through the clearance between the sealing member 18C and the substrate 13 due to the rotation of the substrate 13 during polishing and the rugged upper face of the substrate 13. If the height $t_C$ of the space 21C is small, a resistance to the flow of the fluid is produced in the space 21C, which causes variations in pressure in the space 21C, resulting in unequal pressing of the substrate 13. Hence, it is required to set the height $t_C$ of the space 21C to a value which barely produces a pressure loss in the fluid under pressure flowing through the space 21C. The height $t_C$ of the space 21C is determined by a difference between the thickness of the guiding member 19C and the thickness of the substrate 13. In the case of using a fluid with low viscosity such as water or air (nitrogen) as the fluid under pressure, variations in pressure are rarely observed inside the space 21C if the height $t_C$ of the space 21A is set to a value equal to or larger than 1/1000, preferably a value equal to or larger than 2/1000, of a dimension of the substrate 13. Specifically, it is preferred to set the height $t_C$ of the space 21C to 0.5 mm.

As for the diameter, number, and arrangement of the distribution holes 24*a* formed in the fluid distributing plate 24C, they are preferably determined so that the fluid under pressure supplied through the distribution holes 24*a* to the space 21C equally presses the substrate 13. The distribution holes 24*a* are preferably arranged concentrically and radially. The fluid distributing plate 24C may also be composed of a porous plate.

As described above, since the back face of the guiding member 19C is flush with the lower face of the substrate 13 and the sealing member 18C is pressed downward by the fluid supplied to the space 21C, the back face of the sealing member 18C is in contact with the upper face of the substrate 13. Consequently, if the weight of the sealing member 18C is ignored when the area of the top face of the sealing member 18C is equal to the area of the back face thereof, the peripheral portion of the substrate 13 is pressed against the polishing pad 12 with an equal pressing force to that applied to the central portion of the substrate 13.

Since the sealing member 18C is pushed up by the fluid supplied to the space 21C, the fluid under pressure is liable to leak out through the interface between the sealing member 18C and the substrate 13, so that the area of the top face of the sealing member 18C is preferably larger than the area of the back face thereof. However, since the peripheral portion of the substrate 13 is actually pressed with a force larger than the force applied to the central portion thereof by the weight of the sealing member 18C, it is sufficient to set the area of the top face of the sealing member 18C slightly larger than the area of the back face thereof.

Since the substrate 13 and the sealing member 18C are merely in contact with each other, the fluid under pressure in the space 21C leaks out through the clearance between the substrate 13 and the sealing member 18C. In this case, since the pressing force applied to the rotary shaft 16C is slightly larger than the pressure of the fluid supplied to the space 21C unlike the first and second embodiments, the fluid leaking out of the space 21C neither pushes up the substrate holding head 17C and guiding member 19C nor flows out through the clearance between the guiding member 19C and the polishing pad 12. When the fluid leaking out is confined by the guiding member 19C, the fluid flows into the clearance between the substrate 13 and the polishing pad 12 and pushes up the substrate 13, which reduces a force to press the substrate 13 against the polishing pad 12. To avoid such a situation, it is preferable to set the distance between the substrate 13 and the sealing member 18C to about 0.1 mm and to form the back face of the guiding member 19C with a plurality of grooves 19*a* properly spaced, similarly to the first embodiment.

As described above, with the apparatus for polishing a substrate and by the method of polishing a substrate according to the third embodiment, the substrate 13 is pressed against the polishing pad 12 under the pressure of the fluid supplied through the distribution holes 24*a* of the fluid distributing plate 24C to the space 21C, so that the substrate 13 can be pressed against the polishing pad 12 with an equal pressing force even when the polishing pad 12 is rugged or the substrate 13 is deformed, resulting in equal polishing with respect to the substrate 13.

Moreover, even when such foreign substances as particles are attached to the upper face of the substrate 13, the substrate 13 can be pressed against the polishing pad 12 with an equal pressing force.

Furthermore, since the substrate 13 can be attracted by the substrate holding head 17C through mere suction through the distribution holes 24*a* of the fluid distributing plate 24C, the substrate 13 can be held and conveyed easily.

Thus, with the apparatus for holding a substrate to be polished or by the method of polishing a substrate according to the third embodiment, equal polishing can be performed with respect to the substrate 13 even when the table 11 or polishing pad 12 is rugged or the thickness of the substrate 13 varies from portion to portion, which facilitates the mounting and dismounting of the substrate 13 and the conveyance thereof.

Fourth Embodiment

Below, a description will be given to an apparatus and method for polishing a substrate according to a fourth embodiment.

Figure 9:
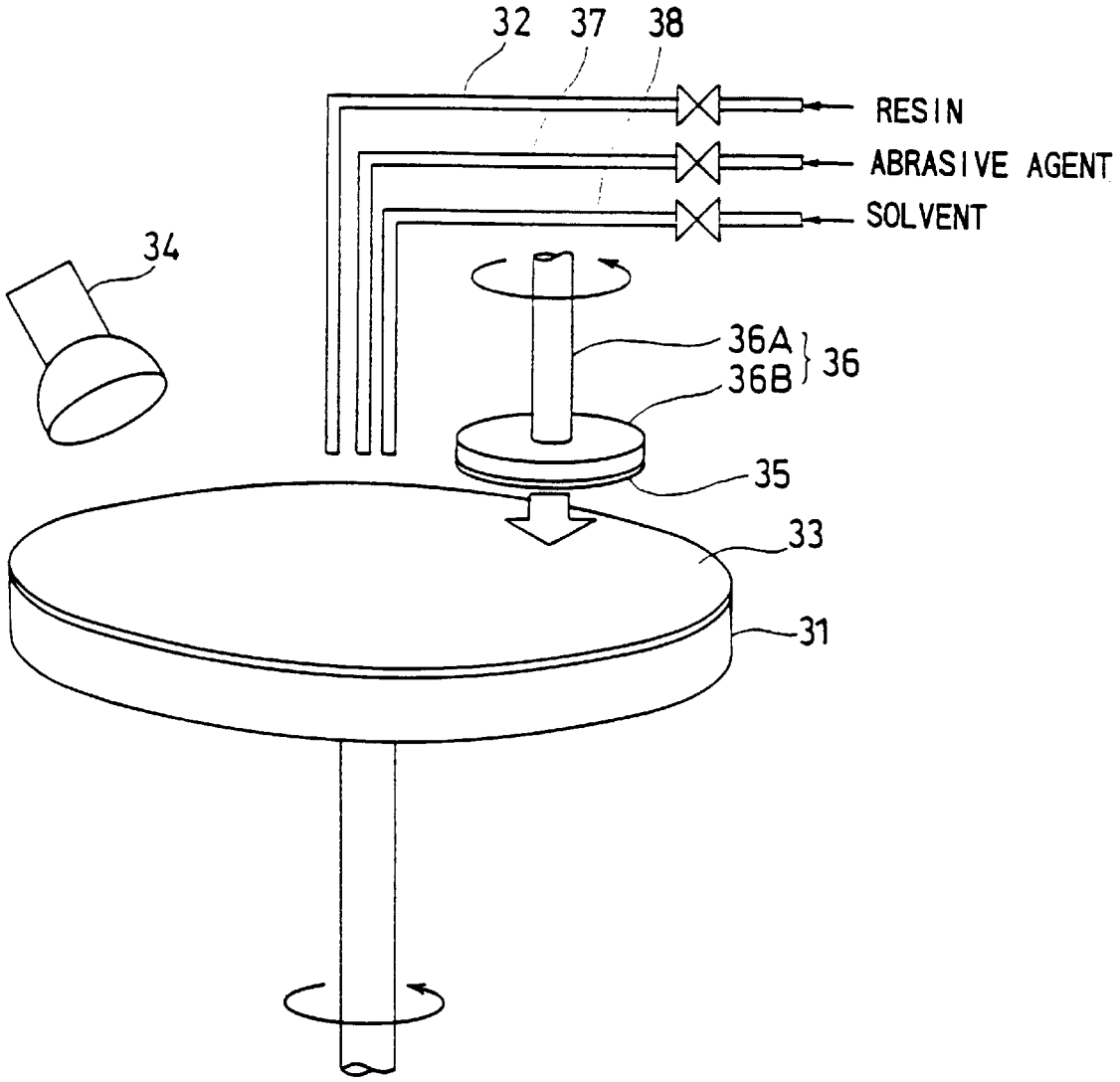
FIG. 9 schematically shows the structure of an apparatus for polishing a substrate according to a fourth embodiment of the present invention.

FIG. 9 schematically shows the structure of the apparatus for polishing a substrate according to the fourth embodiment of the present invention, in which is shown a rotatable table having a flat surface which is made of a rigid material. Above the table 31 is provided a first pipe 32 for supplying a thermosetting liquid resin. The liquid resin is supplied from the first pipe 32 to the entire surface of the table 31 so that the resin which has been uniformly spread under surface tension is cured with the application of heat, resulting in the formation of a resin film 33 for polishing over the surface of the table 31. In this case, the resin is supplied dropwise from the first pipe 32 while the table 31 is rotated, so that the resin is spread under surface tension to form the resin film 33 for polishing with a uniform thickness over the table 31. Over the table 31, the first pipe 32 reciprocally moves in the radial direction from the vicinity of the center of the table 31, while dropping the resin in a prescribed amount onto the table 31 to supply the resin equally over the table 31. The first pipe 32 moves outwardly from above the table 31 when it does not supply the resin. In a position diagonally above the table 31 is provided a heating lamp 34 for heating and curing the resin supplied to the surface of the table 31.

The thickness of the resin film 33 for polishing is on the order of 0.01 mm and about 1/10 of the thickness of a conventional polishing pad, which is on the order of 0.1 mm. As the resin for forming the resin film 33 for polishing, polyurethane, polyethylene, polyimide, or the like can be used. The resin for forming the resin film 33 for polishing can be either hard or soft.

As shown in FIG. 9, a substrate holding apparatus 36 for holding a substrate 35 is placed above the table 31. The substrate holding apparatus 36 includes: a rotary shaft 36A rotated by rotary driving means (not shown); and a substrate holding head 36B in the form of a disc which is integrally formed on the lower edge of the rotary shaft 36A to hold the substrate 35.

Above the table 31 is provided a second pipe 37 for supplying an abrasive agent onto the resin film 33 for polishing formed over the table 31 when the substrate 35 is polished. The substrate 35 is polished with the abrasive agent supplied dropwise from the second pipe 37 onto the resin film 33 for polishing. The second pipe 37 moves to a position above the central portion of the table 31 when it supplies the abrasive agent, while it moves outwardly from above the table 31 when it does not supply the abrasive agent.

Above the table 31 is provided a third pipe 38 for supplying a solvent which dissolves the resin film 33 for polishing formed over the surface of the table 31. When the resin film 33 for polishing is worn out, it is dissolved in the solvent supplied from the third pipe 38 and removed. Over the table 31, the third pipe 38 radially moves from the vicinity of the center of the table 31, while dropping the solvent in a prescribed amount onto the table 31 so that the resin film 33 for polishing that has worn out is dissolved and removed. The third pipe 38 moves outwardly from above the table 31 when the resin film 33 for polishing should not be dissolved.

Thus, with the apparatus for polishing a substrate according to the fourth embodiment, the liquid resin is supplied dropwise onto the rotating table 31 so that the resin is spread under surface tension and cured. Consequently, the resin film 33 for polishing which is flat and uniform in thickness can be formed over the surface of the table 31.

Each of the table 31 and the substrate holding apparatus 36 is made of a material which is not damaged by the solvent supplied from the third pipe 38, such as alumina. In this case, a protective pad made of, e.g., an acrylic resin may be adhered to the surface of the table 31 for a protecting purpose so that the protective pad damaged by breakage of the substrate 35 or the like is replaced as necessary.

Alternatively, the first and third pipes 32 and 38 may be implemented by a single pipe so that it is switched between the supply of the resin and the supply of the solvent by means of a switching valve or the like.

Although the thermosetting resin is supplied from the first pipe 32 and cured with the application of heat in the fourth embodiment, a photo-curing resin may be supplied instead from the first pipe 32 and cured by the radiation of an ultraviolet ray.

Figure 10:
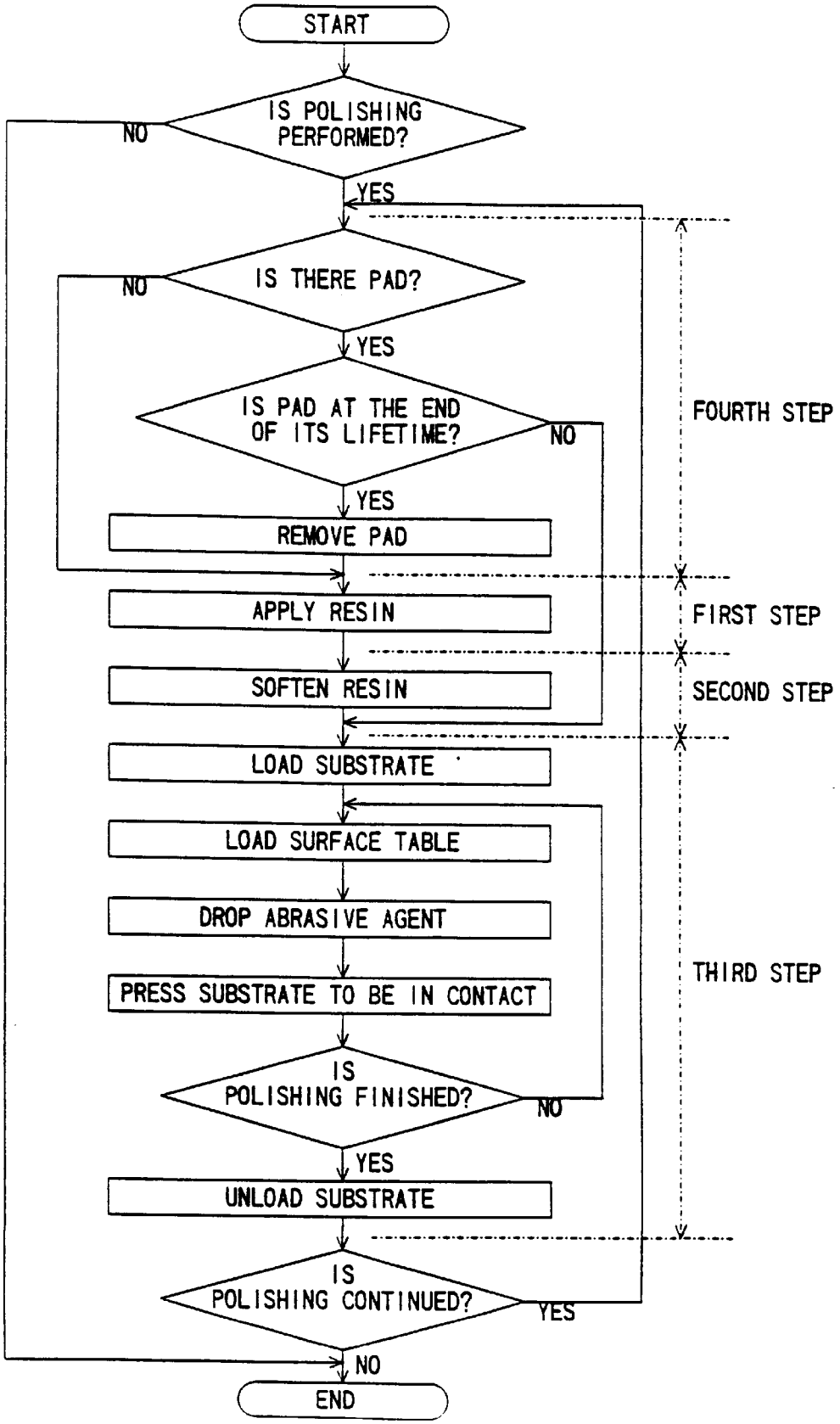
FIG. 10 is a flow chart showing the steps of a method of polishing a substrate according to the fourth embodiment of the present invention.

Below, a polishing method using the apparatus for polishing a substrate according to the fourth embodiment will be described based on the flow chart of FIG. 10.

In a first step, a polyurethane resin dissolved in a solvent, for example, is supplied dropwise onto the table 31, while the table 31 is rotated at, e.g., 30 r.p.m., so as to cover the entire surface of the table 31.

In a second step, the rotation of the table 31 is halted so that the resin on the table 31 is flattened under its own surface tension. Subsequently, the resin over the table 31 is cured with the application of heat by the heating lamp 34 while the table 31 is slowly rotated, resulting in the resin film 33 for polishing (which is referred to as "pad" in FIG. 10 for convenience). In this case, the polyurethane resin dissolved in a solvent is heated to 60° C., while the table 31 is rotated at, e.g., 5 r.p.m., to evaporate the solvent and form the resin film 33 for polishing.

In a third step, the substrate 35 is held by the substrate holding apparatus 36 and moved to a position above the table 31. Thereafter, an abrasive agent containing abrasive grains is supplied dropwise onto the table 31, while the table 31 is rotated, and the substrate holding apparatus 36 is moved downward while rotated in the same direction as the table 31 so that the substrate 35 held by the substrate holding apparatus 36 is pressed against the resin film 33 for polishing and polished. When the polishing of the substrate 35 is complete, the substrate holding apparatus 36 is moved from above the table 31 to a given position to unload the substrate 35. For example, the polishing conditions for polishing the substrate 35 composed of a wafer having a diameter of 200 mm are set so that an abrasive agent composed of an alkaline solution of pH 10 to 11 containing 10 to 15 wt % of silica is dropped at a rate of 200 cc/min, while the table 31 is rotated at 100 r.p.m., and the substrate 35 is pressed against the resin film 33 for polishing to receive a pressure of 300 g/cm on its surface, while the substrate holding apparatus 36 is rotated at 20 r.p.m.

In a fourth step, the solvent for dissolving the resin film 33 for polishing, e.g., an organic solvent such as acetone or a concentrated sulfuric acid is dropped onto the resin film 33 for polishing over the table 3, while the table 31 is rotated, thereby dissolving and removing the resin film 33 for polishing from the surface of the table 31.

By repeatedly performing the above first to fourth steps, the resin film 33 for polishing having varied thickness and an increased degree of ruggedness as a result of polishing, i.e., the resin film 33 for polishing that has worn out can be renewed without a dressing process. Specifically, after the resin film 33 for polishing that has worn out is removed, a new resin film 33 for polishing having a uniform thickness and a flat surface free from ruggedness is formed to stably polish the substrate 35.

Although the liquid resin is supplied dropwise while the table 31 is rotated in the fourth embodiment, it is preferable to control the rotation speed of the table 31 and the amount of the resin to be dropped based on the viscosity of the resin and the type and amount of the solvent.

Although the thermosetting resin is cured with the application of heat by the heating lamp 34 to form the resin film 33 for polishing in the fourth embodiment, the resin may alternatively be cured by the application of heat generated in the course of raising the temperature of the table 31.

Although the abrasive agent containing abrasive grains is supplied in the fourth embodiment, the resin containing abrasive grains may be cured instead to form the resin film 33 for polishing so that a liquid containing no abrasive grains and having controlled pH is supplied onto the resin film 33 for polishing.

In the above fourth process, the resin film 33 for polishing may be renewed after polishing a given number of substrates 35. Alternatively, the resin film 33 for polishing may be renewed at the end of its lifetime, i.e., at a time at which surface uniformity or the ability to tolerate variations in the level of the resin film 33 for polishing exceeds the permissible level.

Alternatively, the original surface uniformity and ability to tolerate variations in the level of the resin film 33 for polishing may be restored without removing the resin film 33 for polishing by supplying the resin from the second pipe 32 onto the resin film 33 for polishing that has worn out at the end of its lifetime to flatten the resin film 33 for polishing. In this case, since the resin film 33 is extremely thin compared with a conventional polishing pad, the surface of the resin film 33 for polishing can be flattened by supplying the resin.

Fifth Embodiment

Figure 11:
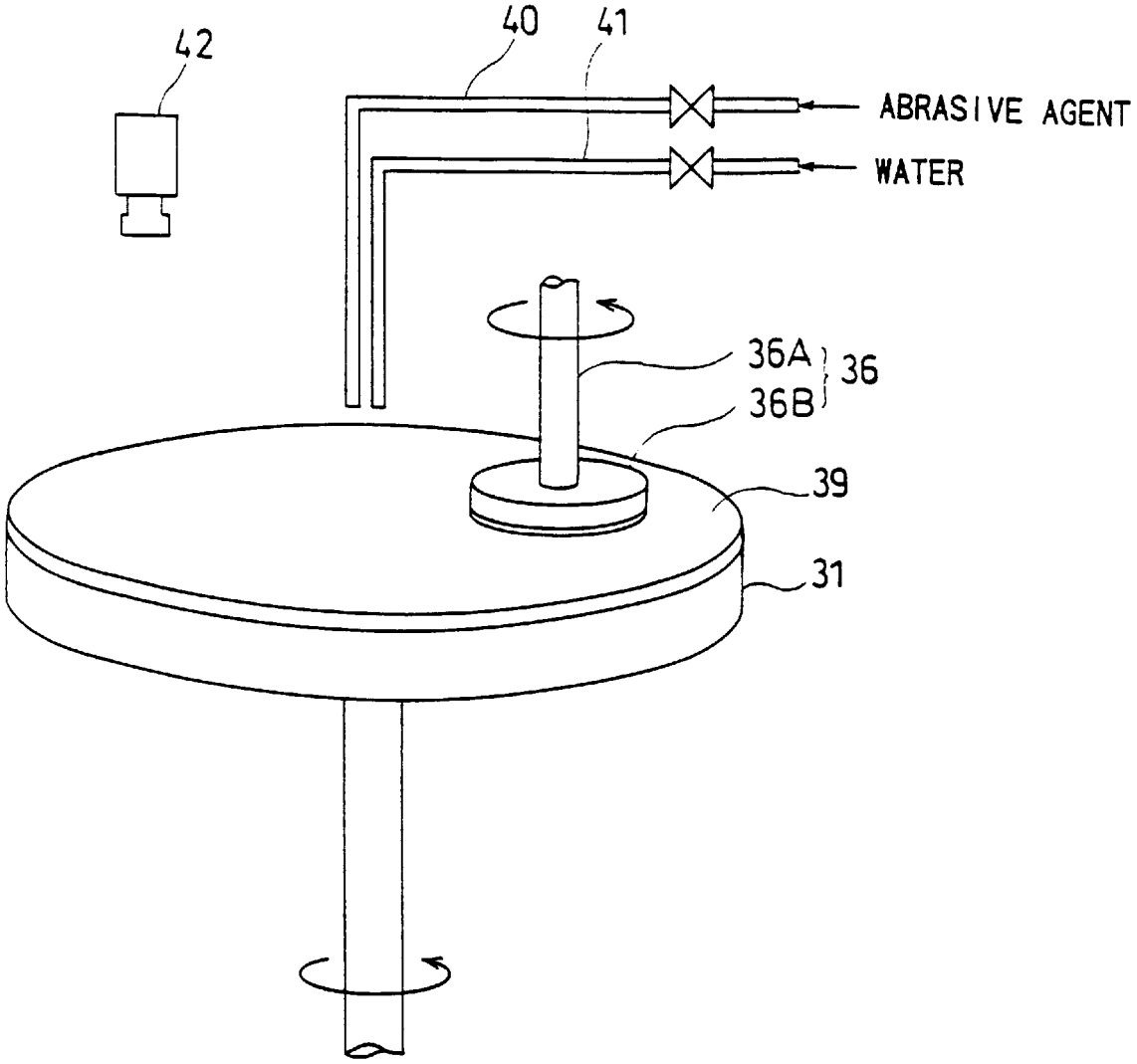
FIG. 11 schematically shows the structure of an apparatus for polishing a substrate according to a fifth embodiment of the present invention.

FIG. 11 schematically shows the structure of an apparatus for polishing a substrate according to a fifth embodiment of the present invention, in which are shown: a rotatable table 31 having a flat surface which is made of a rigid material and is, e.g., red in color; a white, translucent polishing pad 39 adhered to the table 31; a first pipe 40 for supplying an abrasive agent onto the polishing pad 39; a second pipe 41 for supplying cleaning water onto the polishing pad 39; and a camera 42 for measuring the color intensities of R, G, and B of the polishing pad 39. Above the table 31 are provided: a rotary shaft 36A rotated by rotary driving means (not shown); and a substrate holding apparatus 36 having a substrate holding head 36B in the form of a disc which is provided integrally on the lower edge of the rotary shaft 36 to hold the substrate 35, similarly to the first embodiment.

In the apparatus for polishing a substrate according to the fifth embodiment, after water is supplied from the second pipe 41 to clean the surface of the polishing pad 39 and remove the abrasive, the red color intensity of the table 31 passing through the polishing pad 39 is measured by means of a camera 42. If the thickness of the polishing pad 39 is sufficiently thick, the red color of the table 31 does not pass through the polishing pad 39, so that the camera 42 detects the white color of the polishing pad 39 and therefore the signal intensities of R, G, and B are substantially equal. Since the polishing pad 39 is translucent, the red color of the table 31 passing through the polishing pad 39 increases and the signal intensity of R increases as the polishing pad 39 becomes thinner.

Figure 12:
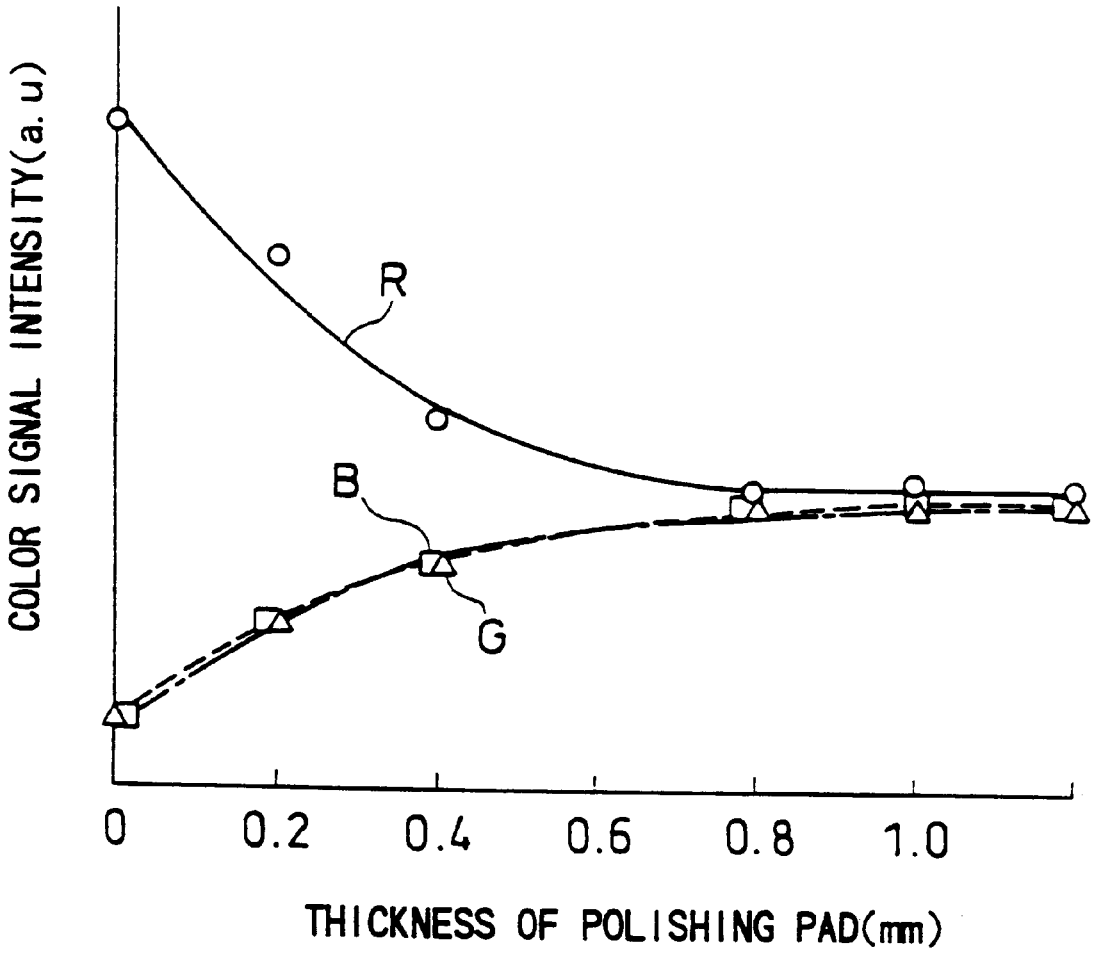
FIG. 12 shows a relationship between the thickness of a polishing pad used in the method of polishing a substrate according to the fifth embodiment of the present invention and signal intensities of colors.
Figure 13:
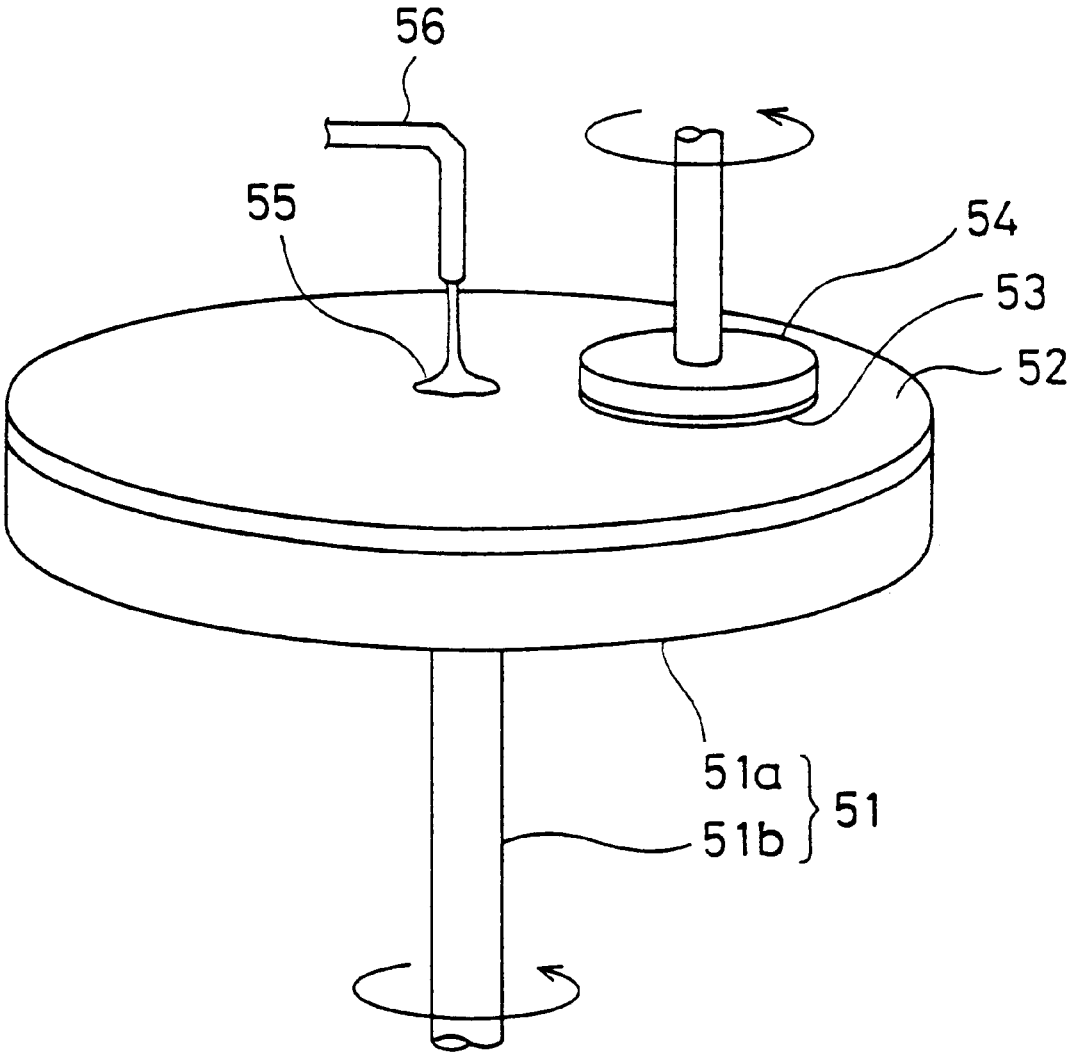
FIG.13 PRIOR ART
FIG. 13 is a schematic perspective view of an apparatus for polishing a substrate according to a first conventional embodiment.
Figure 14:
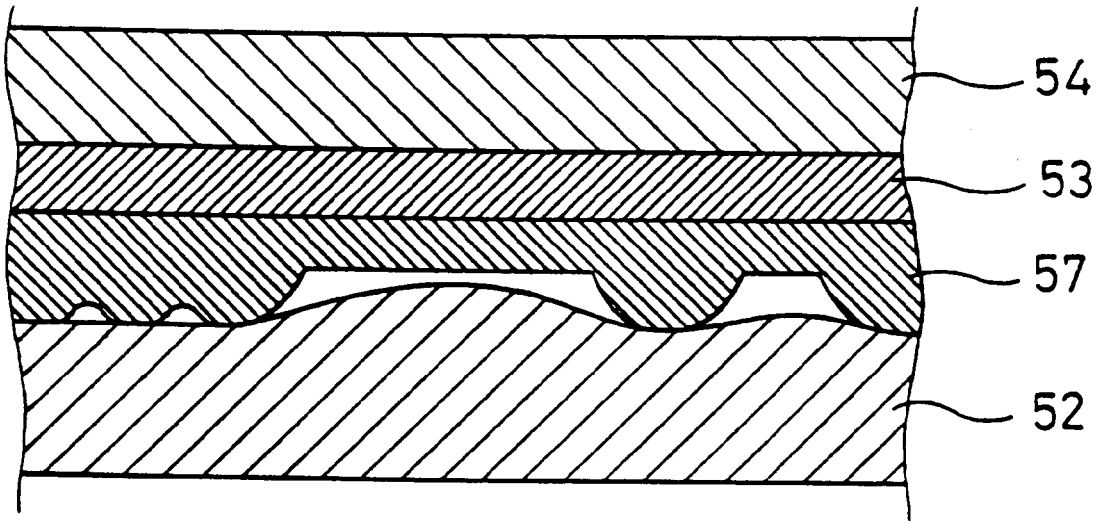
FIG.14 PRIOR ART
FIG. 14 is a schematic view illustrating a polishing method implemented by the above apparatus for polishing a substrate according to the first conventional embodiment.
Figure 15A:
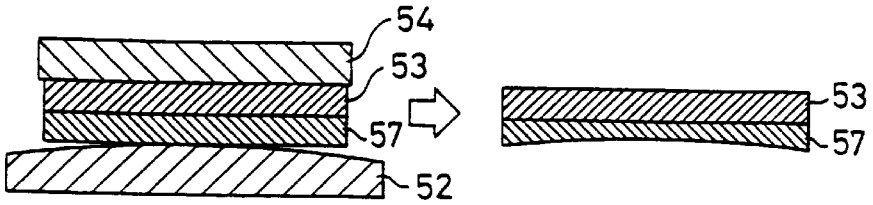
FIG.15(a) PRIOR ART
FIGS. 15(*a*) to 15(*c*) are schematic views illustrating problems in the polishing method implemented by the above apparatus for polishing a substrate according to the first conventional embodiment.
Figure 15B:
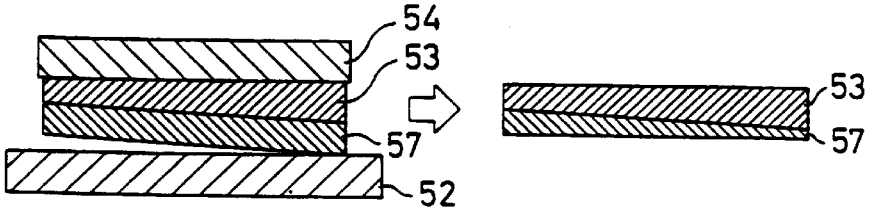
FIG.15(b) PRIOR ART
Figure 15C:
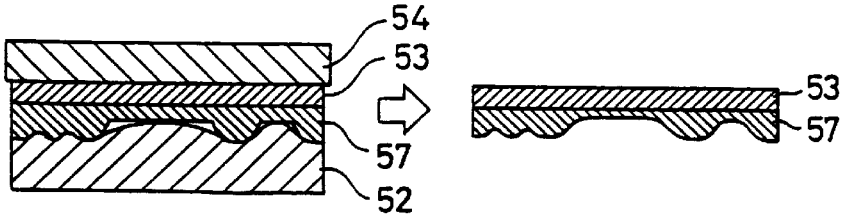
FIG.15(c) PRIOR ART
Figure 16:
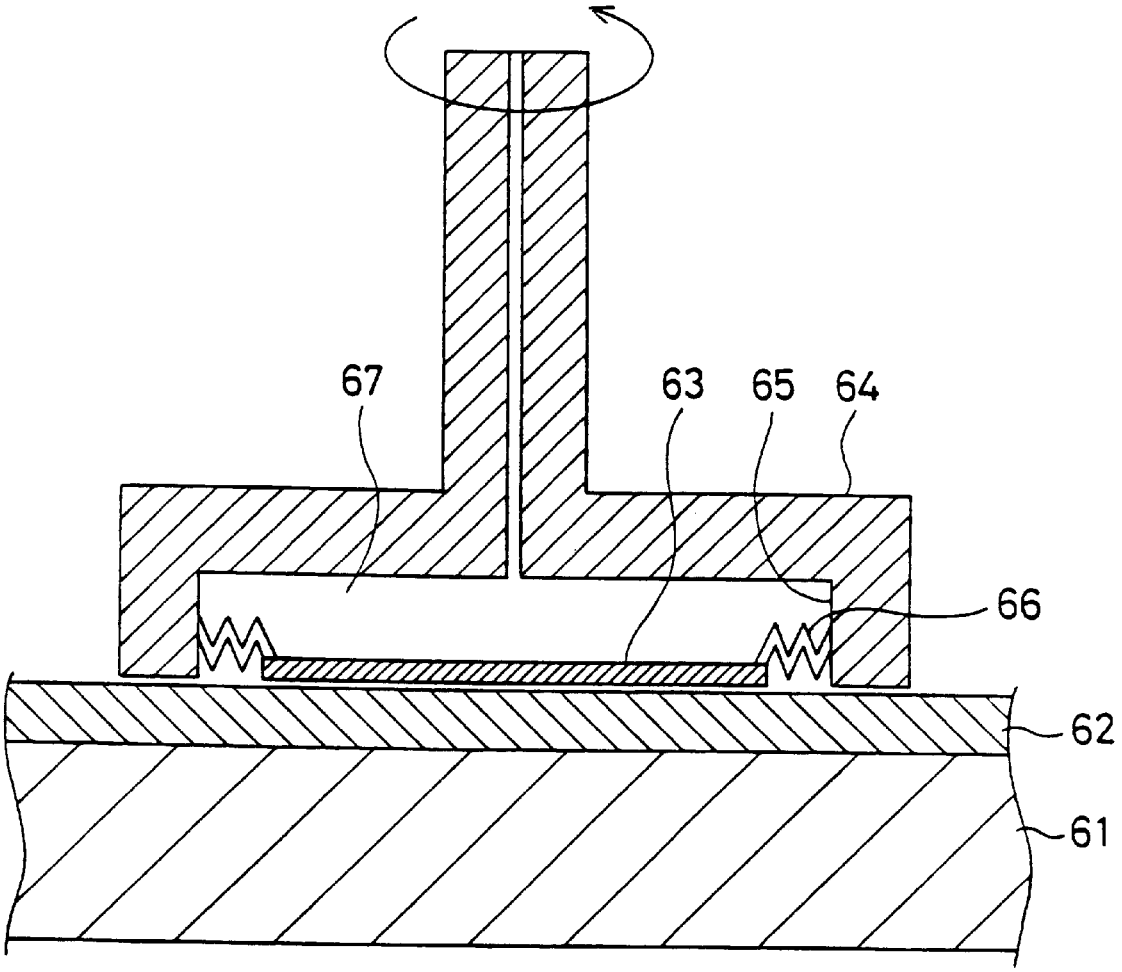
FIG.16 PRIOR ART
FIG. 16 is a schematic cross-sectional view of an apparatus for polishing a substrate according to a second conventional embodiment.

FIG. 12 shows relationships between the thickness of the polishing pad 39 and the signal intensities of R, G, and B, in which the horizontal axis represents the thickness of the polishing pad 39 and the vertical axis represents the signal intensity of color normalized to 1 which is obtained when no polishing pad 39 is provided. As shown in FIG. 12, as the polishing pad 39 becomes thinner, the signal intensity of R becomes higher, while the signal intensities of G and B become lower, which enables the thickness of the polishing pad 39 to be estimated. Moreover, the degree of ruggedness, i.e., variations in the thickness of the polishing pad 39 can be estimated by measuring the signal intensities of R, G, and B at any point of the surface of the table 31.

In the process of fabricating the translucent polishing pad 39, it may be made of a transparent resin containing several wt % of fine particles which do not permeate light or it may be made of a transparent resin formed with fine bubbles to irregularly reflect light.

Although the combination of the red table 31 and the white, translucent polishing pad 39 are used in the fifth embodiment, a combination of a white table 31 and a red, translucent polishing pad 39 may be used instead. In this case, the thickness of the polishing pad 39 can be estimated based on a reduction in the signal intensity of R and increases in the signal intensities of G and B. Various other combinations of colors may also be used instead.

In the case of using a multilayer polishing pad 39, a surface layer of the pad may be translucent, while layers other than the surface layer may be colored, instead of coloring the table 31.

Although the surface of the polishing pad 39 is cleaned with water before the signal intensities of colors are measured in the second embodiment, the abrasive agent on the polishing pad may partially be removed with high-pressure air or the like so that the signal intensities of colors are measured in the area from which the abrasive agent has been removed.

Alternatively, in the above apparatus for polishing a substrate according to the fourth embodiment, a white, translucent resin film 33 for polishing may be formed by supplying a white, translucent resin from the first pipe 32 onto the table 31 colored in, e.g., red so that the signal intensity of the red color of the table 31 passing through the resin film 33 for polishing is measured. In this case, for example, if the signal intensity of the red color exceeds a specified value, a solvent is supplied from the third pipe 38 onto the table 31 to remove the resin film 33 for polishing and then the resin is supplied from the first pipe 32 to form a new resin film 33 for polishing or the resin is supplied from the first pipe 32 to flatten the surface of the resin film 33 for polishing without the removal of the resin film 33 for polishing.

We claim:

1. An apparatus for polishing a substrate, comprising:

a rotatable and rigid table;

a resin supplying means for supplying a liquid resin to a surface of said table so as to form a resin film for polishing;

a resin film operative for polishing, said resin film formed from said liquid resin which is supplied to the surface of said table by said resin supplying means and cured over said surface of said table after being supplied; and substrate holding means for holding the substrate to be polished and pressing the held substrate onto said resin film for polishing.

2. An apparatus for polishing a substrate according to claim 1, further comprising:

resin curing means for curing the liquid resin supplied by said resin supplying means to the surface of said table so as to form said resin film for polishing.

3. An apparatus for polishing a substrate according to claim 2, wherein the resin supplied by said resin supplying means to the surface of said table is thermosetting and said resin curing means heats the resin supplied by said resin supplying mean to the surface of said table so as to cure the resin.

4. An apparatus for polishing a substrate according to claim 2, wherein the resin supplied by said resin supplying means to the surface of said table is photo-curing and said resin curing means illuminates the resin supplied by said resin supplying mean to the surface of said table with an ultraviolet ray so as to cure the resin.

5. An apparatus for polishing a substrate according to claim 1, further comprising:

solvent supplying means for supplying a solvent for dissolving said resin film for polishing onto said table.

6. An apparatus for polishing a substrate, comprising:

a rotatable and rigid table;

a multilayer polishing pad provided on a surface of said table and having a colored lower layer and a translucent upper layer;

substrate holding means for holding the substrate to be polished and pressing the held substrate against said polishing pad; and light intensity measuring means for measuring an intensity of light which is reflected by a surface of said lower layer of said polishing pad and passes through said translucent upper layer thereof, by measuring the signal intensity of color of the reflected light.

* * * * *